US010060192B1

(12) United States Patent
Miess et al.

(10) Patent No.: US 10,060,192 B1
(45) Date of Patent: Aug. 28, 2018

(54) METHODS OF MAKING POLYCRYSTALLINE DIAMOND COMPACTS AND POLYCRYSTALLINE DIAMOND COMPACTS MADE USING THE SAME

(71) Applicant: US Synthetic Corporation, Orem, UT (US)

(72) Inventors: David P. Miess, Highland, UT (US); Robert K. Galloway, Highland, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 553 days.

(21) Appl. No.: 14/460,050

(22) Filed: Aug. 14, 2014

(51) Int. Cl.
*E21B 10/567* (2006.01)
*B24D 3/10* (2006.01)
*B24D 18/00* (2006.01)

(52) U.S. Cl.
CPC ..... *E21B 10/567* (2013.01); *B24D 3/10* (2013.01); *B24D 18/0009* (2013.01)

(58) Field of Classification Search
None
See application file for complete search history.

(56) References Cited

U.S. PATENT DOCUMENTS 4,268,276 A 5/1981 Bovenkerk
4,410,054 A 10/1983 Nagel et al.
4,468,138 A 8/1984 Nagel
4,560,014 A 12/1985 Geczy
4,738,322 A 4/1988 Hall et al.
4,811,801 A 3/1989 Salesky et al.
4,913,247 A 4/1990 Jones
5,016,718 A 5/1991 Tandberg
5,092,687 A 3/1992 Hall
5,120,327 A 6/1992 Dennis
5,135,061 A 8/1992 Newton, Jr.
5,154,245 A 10/1992 Waldenstrom et al.
5,180,022 A 1/1993 Brady
5,364,192 A 11/1994 Damm et al.
5,368,398 A 11/1994 Damm et al.
5,460,233 A 10/1995 Meany et al.
5,480,233 A 1/1996 Cunningham
5,544,713 A 8/1996 Dennis
5,656,045 A * 8/1997 Wiand ..... B24D 3/06 51/307
5,766,394 A * 6/1998 Anderson ..... B24D 3/06 51/307

(Continued)

OTHER PUBLICATIONS

U.S. Appl. No. 12/961,787, filed Dec. 7, 2010, Mukhopadhyay et al.

(Continued)

*Primary Examiner* — Jennifer A Smith
*Assistant Examiner* — Ross J Christie
(74) *Attorney, Agent, or Firm* — Dorsey & Whitney LLP

(57) ABSTRACT

Embodiments of the invention are disclosed for methods of making polycrystalline diamond compacts having substrates including bonding features thereon and polycrystalline diamond bodies including complementary configurations, as well as embodiments of polycrystalline diamond compacts made using the same.

9 Claims, 19 Drawing Sheets

(56) References Cited

U.S. PATENT DOCUMENTS

| | | | | |
|---|---|---|---|---|
| 5,862,873 | A * | 1/1999 | Matthias | E21B 10/5735 51/295 |
| 6,793,681 | B1 | 9/2004 | Pope et al. | |
| 7,516,804 | B2 | 4/2009 | Vail | |
| 7,757,790 | B1 * | 7/2010 | Schmidt | E21B 10/5735 175/432 |
| 7,841,428 | B2 | 11/2010 | Bertagnolli | |
| 7,866,418 | B2 | 1/2011 | Bertagnolli et al. | |
| 7,870,913 | B1 | 1/2011 | Sexton et al. | |
| 7,874,472 | B2 | 1/2011 | Lee et al. | |
| 7,971,663 | B1 | 7/2011 | Vail | |
| 7,972,397 | B2 | 7/2011 | Vail | |
| 8,080,071 | B1 | 12/2011 | Vail | |
| 8,236,074 | B1 | 8/2012 | Bertagnolli et al. | |
| 8,689,913 | B2 | 4/2014 | Cooley et al. | |
| 2006/0157285 | A1 * | 7/2006 | Cannon | E21B 10/36 175/374 |
| 2006/0237236 | A1 * | 10/2006 | Sreshta | B22F 7/02 175/426 |
| 2008/0206576 | A1 * | 8/2008 | Qian | B24D 3/10 51/307 |
| 2009/0183925 | A1 * | 7/2009 | Zhang | E21B 10/5676 175/432 |
| 2010/0012388 | A1 * | 1/2010 | Shamburger | E21B 10/54 175/431 |
| 2010/0012389 | A1 * | 1/2010 | Zhang | B24D 99/005 51/307 |
| 2010/0242375 | A1 * | 9/2010 | Hall | B22F 3/14 51/307 |
| 2011/0036643 | A1 * | 2/2011 | Belnap | C22C 26/00 51/307 |

OTHER PUBLICATIONS

U.S. Appl. No. 13/027,954, filed Feb. 15, 2011, Miess et al.

U.S. Appl. No. 13/037,548, filed Mar. 1, 2011, Gonzalez et al.

U.S. Appl. No. 13/795,027, filed Mar. 12, 2013, Mukhopadhyay et al.

Hosomi et al. "Diamond Formation by a Solid State Reaction" Science and Technology of New Diamond; pp. 239-243; Terra Scientific Publishing Company (1990).

Marchelli et al. "New Material Systems for 3D Ceramic Printing" Department of Mechanical Engineering, University of Washington; pp. 477-498 (Sep. 15, 2009).

Noguera et al."3D fine scale ceramic components formed by ink-jet prototyping process" (Apr. 11, 2005).

Tanaka et al. "Formation of Metastable Phases of Ni-C and Co-C Systems by Mechanical Alloying" Metallurgical Transactions A; Sep. 1992, vol. 23, Issue 9, pp. 2431-2435.

Tang et al. "Preparation and performance of diamond coating on cemented carbide inserts with cobalt boride interlayers" Diamond and Related Materials 9 (2000) 1744-1748.

Wang et al. "Fabrication and application of boron-doped diamond coated rectangular-hole shaped drawing dies" Int. Journal of Refractory Metals and Hard Materials 41 (2013) 422-431.

Yoo et al. "Structural Ceramic Components by 3D Printing" Department of Materials Science and Engineering and Mechanical Engineering, Massachusetts Institute of Technology; pp. 40-50 (Jun. 1992).

* cited by examiner

METHODS OF MAKING POLYCRYSTALLINE DIAMOND COMPACTS AND POLYCRYSTALLINE DIAMOND COMPACTS MADE USING THE SAME

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond body or table. The diamond table is formed and bonded to a substrate using a high-pressure/high-temperature ("HPHT") process. The PDC cutting element may also be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container or cartridge with a volume of diamond particles positioned on a surface of the cemented carbide substrate. A number of such cartridges may be loaded into an HPHT press. The substrate(s) and volume of diamond particles are then processed under HPHT conditions in the presence of a catalyst material that causes the diamond particles to bond to one another to form a matrix of bonded diamond grains defining a polycrystalline diamond ("PCD") body or table. The catalyst material is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a metal-solvent catalyst to promote intergrowth between the diamond particles, which results in the formation of a matrix of bonded diamond grains having diamond-to-diamond bonding therebetween, with interstitial regions between the bonded diamond grains being occupied by the metal-solvent catalyst.

Despite the availability of a number of different types of PDCs, manufacturers and users of PDCs continue to seek improved PDCs.

SUMMARY

Embodiments of the invention relate to methods of forming a PDC by bonding a previously formed PCD body (i.e., a preformed PCD body) to a substrate using a number of different techniques. For example, embodiments disclosed herein may provide improved bonding between the PCD body from the substrate for increasing impact resistance and/or delamination resistance of the PCD body from the substrate during cutting operations.

In an embodiment, a method for forming a PDC is disclosed. The method includes forming a precursor assembly including a substrate, a preformed PCD body, and an infiltrant having carbon material therein. The infiltrant is positioned between the substrate and the preformed PCD body. The method further including subjecting the precursor assembly to an HPHT process to bond the preformed PCD body to the substrate and form the PDC.

In an embodiment, a method for making a PDC is disclosed. The method includes forming a PCD body having an upper surface, a lower bonding surface generally opposite the upper surface, and at least one lateral surface extending therebetween. The method further includes providing a substrate having an interfacial surface including at least one substrate bonding feature thereon having a PCD portion. The method further includes positioning the interfacial surface of the substrate including the at least one substrate bonding feature having the PCD portion adjacent to the lower bonding surface of the PCD body, and subjecting the substrate and PCD body to at least one of an HPHT process or a brazing process to bond the PCD body to the substrate.

In an embodiment, a method of making a PDC is disclosed. The method includes providing a substrate having an interfacial surface including at least one substrate bonding feature. The method includes providing a plurality of segments of a multiple segment PCD body. Each of the plurality of segment includes an outer side; a first end; a second end; an upper, working surface; and a lower, bonding surface. The method includes positioning each of the plurality of the segments such that each individual segment engages an adjacent segment at the first end or the second end until all segments are placed adjacent to one another to thereby form an assembled multiple segment PCD body. The resulting assembled multiple segment PCD body has an upper, working surface; a lower, bonding surface generally opposite the working surface; at least one lateral surface therebetween; and a configuration complementary to the shape of the substrate bonding feature. The method further includes bonding to the assembled multiple segment PCD body to the substrate, by placing the assembled multiple segment PCD body on or around the substrate bonding feature, and performing at least one of an HPHT process or a brazing process.

In an embodiment, a multiple segment PDC is disclosed. The PDC including a substrate having an interfacial surface including a raised portion extending above the interfacial surface and a preformed PCD body bonded to the substrate. The preformed PCD body includes a plurality of PCD segments laterally arranged with respect to one another (e.g., circumferentially adjacent) to form a collective PCD body having a complementary configuration to the raised portion of the substrate bonding feature.

In an embodiment a PDC is disclosed. The PDC includes a substrate including an interfacial surface; a first preformed PCD body having a working surface, a bonding surface, at least one lateral surface, an interior surface defining at least one hole extending therethrough from the working surface to the bonding surface; and a second PCD body at least partially filling the at least one hole in the first PCD body. The second PCD body may be bonded to the first preformed PCD body at the interior surface of the first preformed PCD body and to the substrate on at least the interfacial surface inside the hole of the first preformed PCD body. The first preformed PCD body may be bonded to the substrate at least partially by the second PCD body.

In another embodiment, a PDC is disclosed. The PDC may include a substrate including an interfacial surface having a raised portion extending a height above the interfacial surface; and a lower PCD body that at least partially extends around the raised portion of the PCD body. The lower PCD body includes a working surface having a height about the same or less than the raised portion, a bonding surface, and a lateral surface therebetween. The PDC includes an upper PCD body bonded to the raised portion of the substrate. The upper PCD body exhibits a larger lateral dimension than the raised portion.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

Embodiments of the invention relate to methods of forming a PDC by bonding a previously formed PCD body to a substrate using a number of different techniques. For example, embodiments disclosed herein may provide improved bonding between the PCD body from the substrate for increasing impact resistance and/or delamination resistance of the PCD body from the substrate during cutting operations. Embodiments herein may provide a greater mechanical and/or chemical bond between the PCD body and the substrate, thereby providing improved impact resistance and/or reduced incidence of delamination or separation. For example, embodiments may provide at least one of disruption of residual stresses in the PCD body, limit crack propagation in the PCD body, or the transfer of heat and/or stresses through the PCD body during operations. For example, a PDC having a multiple segment PCD body may contain breakage and/or damage to a specific region or segment of the multiple segment PCD body, which segment may be replaced or the PDC rotated to position another segment or portion of the PCD body in the cutting position without replacing the entire PCD body or PDC.

Figure 1:
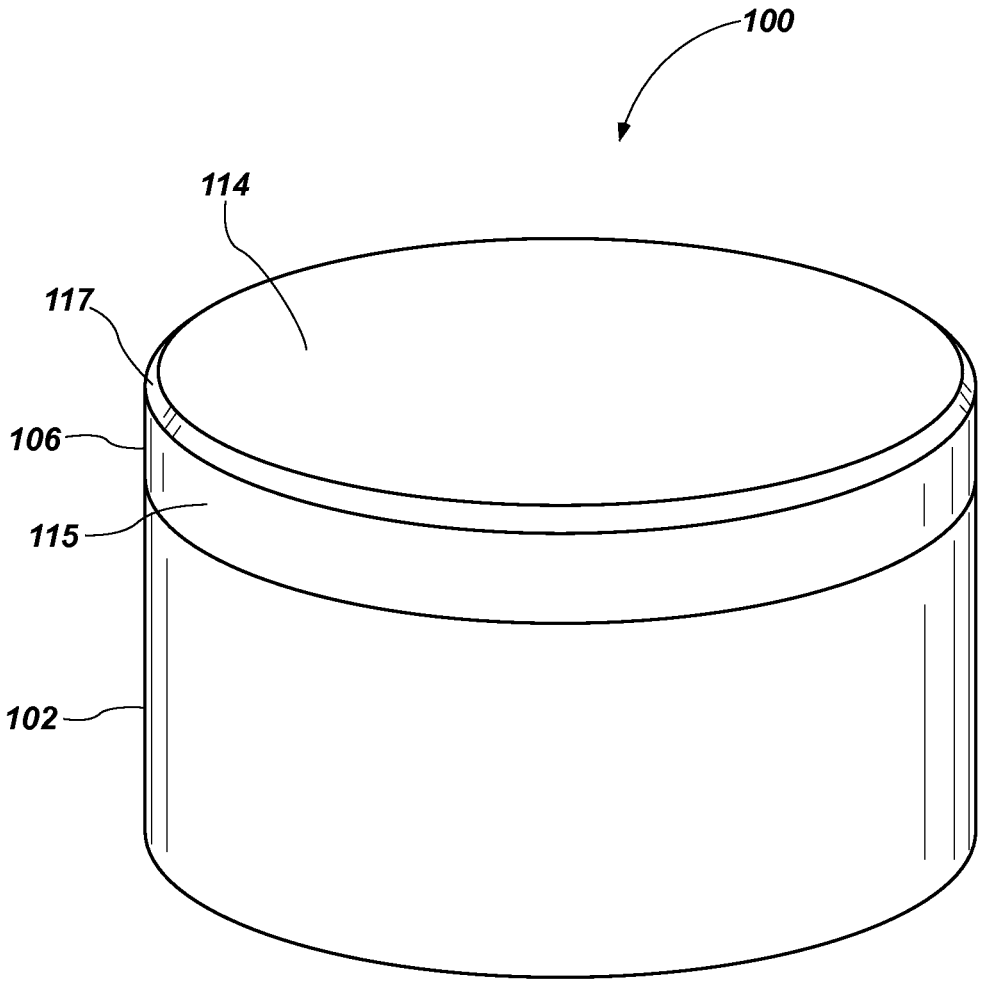
FIG. 1 is an isometric view of a PDC according to an embodiment.

Generally and with reference to FIG. 1, a PDC 100 includes at least one PCD body 106 bonded to a substrate 102. The PCD body 106 exhibits at least one working surface 114 having at least one lateral dimension "d" (e.g., a diameter or other lateral dimension), at least one bonding surface 115 generally opposite the working surface 114, at least one lateral surface 116 extending between the bonding surface 115 and the working surface 114, and an optional chamfer 117 extending between the working surface 114 and the at least one lateral surface 116. Although FIG. 1 shows the working surface 114 as substantially planar, the working surface 114 may be concave, convex, or another non-planar geometry.

The substrate 102 may be generally cylindrical or another selected configuration, without limitation. The substrate 102 may include, without limitation, cemented carbides, such as tungsten carbide, titanium carbide, chromium carbide, niobium carbide, tantalum carbide, vanadium carbide, or combinations thereof cemented with iron, nickel, cobalt, or alloys thereof. For example, in an embodiment, the substrate 102 comprises cobalt-cemented tungsten carbide.

The PCD body 106 includes a plurality of diamond grains directly bonded together via diamond-to-diamond bonding (e.g., $sp^3$ bonding) to define a plurality of interstitial regions therebetween. At least a portion of the plurality of interstitial regions, or in some embodiments, substantially of the interstitial regions may be occupied by a metal-solvent catalyst, such as iron, nickel, cobalt, or alloys of any of the foregoing metals. The PCD body 106 may exhibit an average diamond grain size of about 50 μm or less, such as about 30 μm or less or about 20 μm or less. For example, the average grain size of the diamond grains may be about 10 μm to about 18 μm and, in some embodiments, about 15 μm to about 25 μm. In some embodiments, the average grain size of the diamond grains may be about 10 μm or less, such as about 2 μm to about 5 μm or submicron. It is noted that the as-sintered diamond grain size may differ from the average particle size of the diamond particles prior to sintering due to a variety of different physical processes, such as grain growth, diamond particles fracturing, carbon provided from another carbon source (e.g., dissolved carbon in the metal-solvent catalyst), or combinations of the foregoing. A PDC or a portion thereof (e.g., a portion of the PCD body 106) as described above may be used to form a portion of the PCD bodies and/or PDC in the embodiments described herein. For example, the PCD body 106 may be formed on the substrate 102. The PCD body 106 may be removed from the substrate 102 and be further processed for use in any embodiment described herein by bonding the removed PCD body to another substrate, as desired.

Figure 2A:
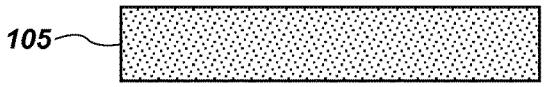
FIG. 2A is a side cross-sectional view of diamond powder according to an embodiment.
Figure 2B:
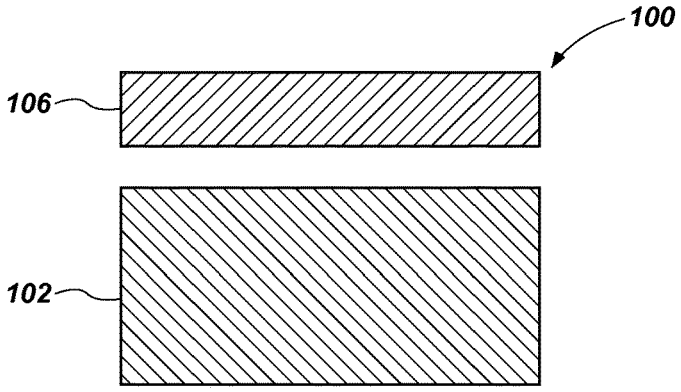
FIG. 2B is a side cross-sectional view of a polycrystalline diamond body according to an embodiment.
Figure 2C:
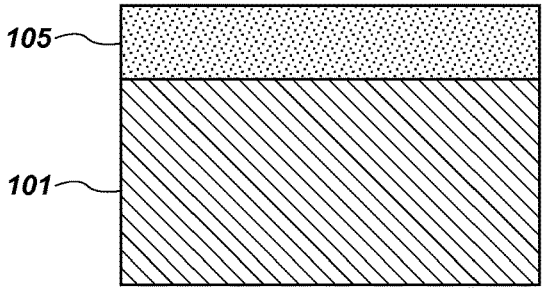
FIG. 2C is a side cross-sectional view of diamond powder positioned on a substrate according to an embodiment.

Referring to FIGS. 2A and 2C, the PCD body 106 may be formed by placing a suitable diamond powder 105 in a refractory metal can or other suitable enclosure, placing the can into a pressure transmitting medium, and subjecting the pressure transmitting medium including the can and the diamond powder 105 therein to HPHT process effective to sinter the diamond particles of the diamond powder 105 together to form the PCD body 106. The HPHT sintering process may be carried out with the diamond powder 105 in the presence of a metal-solvent catalyst (e.g., iron, cobalt, nickel, or alloys of the foregoing), which may be provided in the form of a powder, a foil or disc, and/or from a substrate. Suitable pressure transmitting mediums may include a graphite structure and/or pyrophyllite. Suitable pressures for the HPHT process may include cell pressures of about 5 GPa or greater, such as, about 5 GPa to about 15 GPa, about 6 GPa to about 10 GPa, about 7 GPa to about 9 GPa, about 7 GPa and greater, about 5 GPa, about 6 GPa, about 7 GPa, or about 7.5 GPa. Suitable temperatures for the HPHT process may include temperatures at which diamond is stable. For example, diamond-stable temperatures used in the HPHT process may include a temperature at least about 1000° C., such as about 1100° C. to about 2200° C., about 1200° C. to about 1800° C., about 1300° C. to about 1600° C., about 1200° C., about 1300° C. about 1400° C., about 1500° C., about 1200° C. or greater, or about 1400° C. or greater.

In some embodiments, the diamond particles of the diamond powder 105 may have a single mode or mixtures of more than one mode of diamond particle sizes. Such diamond powders 105 may exhibit at least one average diamond particle size. Suitable average diamond particle sizes include 100 μm and smaller, such as, 50 μm and smaller, 20 μm and smaller, 10 μm and smaller, about 10 μm to about 50 μm, about 15 μm to about 30 μm, about 10 μm to about 20 μm, about 20 μm, about 10 μm, about 5 μm, or submicron particles.

In embodiments, the diamond powders 105 may be a mixture comprising a multi-modal diamond particle size distribution, such as a bimodal, trimodal, or greater average diamond particle size distribution. For example, a bimodal diamond powder 105 (e.g., diamond particle mixture) may exhibit a first average diamond particle size and a second average diamond particle size. By way of non-limiting example, a suitable bimodal diamond powder 105 may include the first average diamond particle size of about 10 μm or greater (e.g., 10 μm to about 50 μm, about 15 μm to about 40 μm, about 20 μm to about 30 μm, about 15 μm, about 18 μm, about 20 μm, about 25 μm, or about 30 μm) and the second average diamond particle size of about 1 μm to about 20 μm (e.g., about 2 μm to about 15 μm, about 4 μm to about 10 μm, about 2 μm, about 5 μm, about 10 μm, or about 15 μm). Further, smaller average particle size distributions are contemplated herein. For example, a multimodal diamond powder 105 may include any of the above average diamond particle size distributions in the first mode and include the second mode exhibiting the average diamond particle size distribution of less than about 1 μm, such as, about 1 nm to about 500 nm, about 10 nm to about 250 nm, about 20 nm to about 100 nm, about 5 nm, about 10 nm, about 20 nm, about 50 nm, about 100 nm, about 250 nm, or about 500 nm. In an embodiment, any one of the average diamond particle sizes recited herein may be used in combination with another average diamond particle size to create a multimodal diamond powder 105, so long as the average diamond particle sizes differ from each other.

With continued reference to FIG. 2A, after the HPHT sintering process, substantially as any described herein, the individual particles of the diamond powder 105 may be substantially interconnected (i.e., bonded together) to form bonded diamond grains defining a plurality of interstitial spaces therebetween. The resulting sintered PCD body 106 may also include a catalyst material in the interstitial spaces between bonded diamond grains. For example, metal-solvent catalyst may be disposed in at least a portion of the plurality of interstitial spaces in the PCD body 106. Suitable metal-solvent catalysts may include iron, cobalt, nickel, alloys or mixtures of the foregoing, or alloys or mixtures including the forgoing and further infiltrant materials such as silicon or boron. Suitable examples of metal-solvent catalysts and infiltrant materials as well as brazing techniques are disclosed in U.S. patent application Ser. No. 13/795,027 filed Mar. 12, 2013, and U.S. Pat. No. 8,236,074, which are incorporated herein, in their entirety, by this reference.

In some embodiments, the metal-solvent catalyst may be placed in, on, and/or adjacent to the diamond powder 105, in the form of a powder, foil, disc, or constituent of a substrate. For example, the diamond powder 105 may include cobalt particles intermixed with the diamond particles. In an embodiment, a cobalt-containing foil, disc, or powder may be placed on or adjacent to the diamond powder. In an embodiment, a cobalt-containing substrate (e.g., cobalt-cemented tungsten carbide substrate) or substrate particle mixture containing a cobalt cementing constituent may be placed in contact with the diamond powder. During HPHT sintering, the metal-solvent catalyst may at least partially melt and sweep into the diamond powder or sintered diamond grains, the melted cobalt aiding the dissolution of $sp^2$ carbon and/or precipitation of $sp^3$ carbon, which may increase diamond-to-diamond bonding in the resulting sintered PCD body 106.

FIG. 2B depicts an embodiment of a sintered PCD body 106, either at least partially leached or unleached, which may be placed adjacent to or on the substrate 102 (e.g., a cobalt-cemented tungsten carbide substrate) for subsequent bonding thereto to form a PDC 100. The PDC 100 made according to the above is referred to as a two-step PDC. Bonding the PCD body 106 to the substrate 102 may be accomplished by HPHT bonding and/or brazing.

An HPHT bonding process may be substantially similar to the HPHT sintering process disclosed above for sintering diamond particles, including temperature and pressure conditions (i.e. diamond stable conditions) in which an infiltrant such as a metal-solvent catalyst from the cemented carbide substrate infiltrates into the interstitial regions of the at least partially leached PCD table and bonds the infiltrated PCD table to the cemented carbide substrate upon cooling from the HPHT process. In some embodiments, the cell pressure in the pressure transmitting medium in the HPHT bonding process may be lower than the pressure used to sinter the PCD body 106. For example, the HPHT bonding pressure may be about 4 GPa to about 7 GPa, about 5 GPa to about 6 GPa, about 4 GPa, about 5 GPa or less, about 6 GPa or less, or about 7 GPa or less, wherein the HPHT bonding pressure is lower that the HPHT sintering pressure used to form the PCD body 106. In some embodiments, the HPHT bonding temperature may be lower than the HPHT sintering temperature. For example, the HPHT bonding temperature may be at least about 1000° C., such as about 1000° C. to about 2000° C., about 1100° C. to about 1600° C., about 1200° C. to about 1500° C., about 1100° C., about 1200° C., about 1300° C., about 1500° C., about 1000° C. or greater, about 1200° C. or greater, about 500° C. less than the HPHT sintering temperature, about 400° C. less than the HPHT sintering temperature, about 300° C. less than the HPHT sintering temperature, about 200° C. less than the HPHT sintering temperature, or about 400° C. less than the HPHT sintering temperature.

Generally, a one-step PDC may be formed by placing a plurality of diamond particles (i.e. un-bonded diamond particles, diamond powder 105) adjacent to a cemented carbide substrate 102 to form a precursor assembly as illustrated in FIG. 2C and subjecting the plurality of diamond particles (i.e., diamond powder 105) and the cemented carbide substrate 102 to an HPHT sintering process under diamond stable HPHT conditions. The precursor assembly may be cold pressed prior to sintering. During the HPHT sintering process, the metal-solvent catalyst from the substrate 102 at least partially melts and sweeps into interstitial regions between the diamond grains to catalyze growth of diamond and formation of diamond-to-diamond bonding between adjacent diamond particles so that a PCD body so formed bonds to the cemented carbide substrate upon cooling from the HPHT sintering process.

The metal solvent catalyst that occupies at least a portion of the interstitial regions of the PCD body 106 may be present in an amount of about 7.5 weight % ("wt %") of the PCD body 106 or less, such as about 1 wt % to about 7.5 wt %, about 1 wt % to about 6 wt %, about 3 wt % to about 6 wt %, less than about 3 wt %, or a residual amount to about 1 wt %. By maintaining the metal-solvent catalyst content below about 7.5 wt %, the PCD body 106 may exhibit a desirable level of thermal stability suitable for subterranean drilling applications.

Additional details of examples of one-step and two-step processes for fabricating a PDC are disclosed in U.S. application Ser. No. 12/961,787 filed 7 Dec. 2010; and U.S. Pat. No. 7,866,418 issued on 11 Jan. 2011, both of which are incorporated herein, in their entirety, by this reference. Any portions of a PDC or PCD body or process of making the same disclosed in U.S. application Ser. No. 12/961,787; and U.S. Pat. No. 7,866,418 may be used herein for all or a portion of a PCD body and/or PDC.

After bonding to a final substrate (or in the case of a two-step PDC, before and/or after bonding to a substrate), the one-step and two-step PDCs or portions thereof (i.e., PCD body) may be subjected to a leaching process to remove at least a portion of the metal-solvent catalyst or infiltrant from the PCD body to a selected depth therein and from one or more exterior surfaces. Leaching may be carried out by placing at least a portion of the PCD body into an acid bath in a leaching vessel for a predetermined period of time. Leaching may include elevated temperatures and pressures inside of the leaching vessel (e.g., Teflon coated pressure vessel). Removal of the metal-solvent catalyst or infiltrant may help improve thermal stability and/or wear resistance of the PCD body during use.

Examples of acids used in leaching include, but are not limited to, aqua regia, nitric acid, hydrochloric acid, hydrofluoric acid, and mixtures thereof. For example, leaching the PCD body 106 may form a leached region that extends inwardly from the working surface 114, the lateral surface 116, and the chamfer 117 to a selected leached depth. The selected leached depth may be about 100 μm to about 1000 μm, about 100 μm to about 300 μm, about 300 μm to about 425 μm, about 350 μm to about 400 μm, about 350 μm to about 375 μm, about 375 μm to about 400 μm, about 500 μm to about 650 μm, or about 650 μm to about 800 μm. Alternatively, the PCD body 106 may be leached substantially the entire depth of the PCD body 106 depending on leaching conditions. A leached region of the PCD may still include a residual amount of metal-solvent catalyst therein.

Figure 2D:
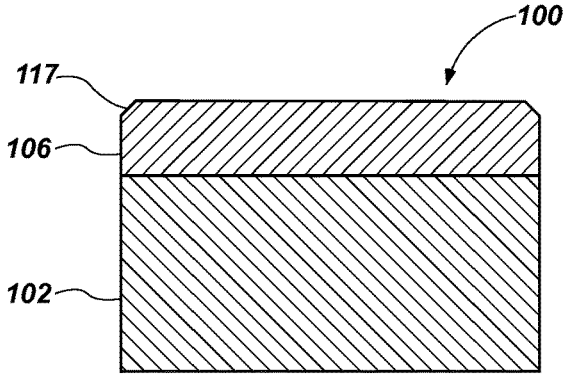
FIG. 2D is a side cross-sectional view of a PDC according to an embodiment.

The one-step and two-step PDCs made according to the above may resemble the PDC 100 in FIG. 2D, including a sintered PCD body 106 bonded to a substrate 102. While the lateral surface 116 of the PCD body 106 and the substrate 102 are illustrated as substantially cylindrical, In some embodiments, the substrate 102 and the lateral surface 116 may collectively exhibit three-dimensional shapes other than circular cylinders, such as three-dimensional polygonal shapes (e.g., cuboid, prismatic (e.g., pentagonal prism), pyramidal, etc.), conical, oval-cylinders, three-dimensional gear shapes (e.g., rounded extruded gear shape), oblong and/or rounded three-dimensional polygons, extruded amorphous shapes, and combinations of the foregoing.

In some embodiments, any of the above-described methods, materials (e.g., diamond powders, catalysts, substrates, at least partially leached PCD's) and variations thereof may be used to make or otherwise provide at least a portion of the PCD bodies for the embodiments of PDC's and components (e.g., PCD body and/or substrate) thereof described in more detail below. For example, a PDC comprising a PCD body and a substrate may be formed from a diamond powder exhibiting an average diamond particle size of about 20 μm or less. The diamond powder may have been positioned on the substrate, loaded into a refractory metal can, and subjected to HPHT sintering conditions including a sintering temperature of about 1200° C. to about 1200° C. and a sintering cell pressure of at least about 7.0 GPa. The resulting PCD body may be separated from the substrate, at which point the PCD body may be further processed and/or at least partially leached. The PCD may be subjected to further processing such as shaping or dimensioning (e.g., cutting, grinding, lasing, EDM, etc.) to provide a final dimensioned PCD body or a portion thereof, such as an annular PCD body, a PCD body having a reduced thickness in a portion thereof (e.g., a PCD disk), a portion or segment of a PCD body having protrusions or indentations thereon, or combinations thereof. The shaped or dimensioned portion or PCD body may be used as at least portion of a PDC. A substrate or a portion thereof may be made or provided for use in any of the embodiments described herein, in a substantially similar manner as the PCD body described above.

Figure 3:
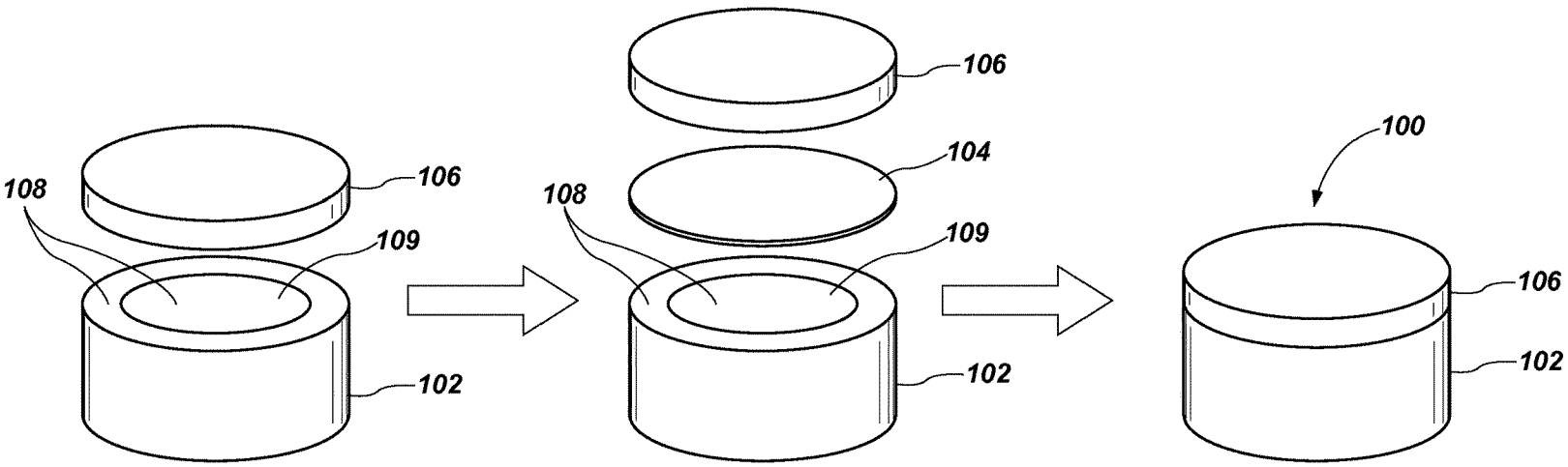
FIG. 3 is a schematic representation of a process of forming a PDC according to an embodiment.

FIG. 3 is a flow diagram of a method of making a PDC according to an embodiment. A PCD body 106 may be positioned adjacent to a substrate 102. In some embodiments, the substrate 102 may include a substrate bonding feature 109 located at an interfacial surface 108 of the substrate 102. The substrate bonding feature 109 may provide enhanced engagement and/or bonding between the PCD body 106 and the substrate 102. For example, the substrate bonding feature 109 may be a PCD portion embedded in the substrate 102 and may form at least a portion of the interfacial surface 108. An infiltrant 104 may be placed between the PCD body 106 and the substrate 102. The infiltrant 104 may include an infiltrant material suitable for infiltrating the PCD body (e.g., cobalt, iron, nickel, alloys of the foregoing). As discussed in more detail below, the infiltrant 104 may, optionally, include diamond seed material, such as a carbon material including, but not limited to, diamond particles, graphite, fullerenes, carbon onions, or combinations of the foregoing. An at least partially leached or unleached PCD body 106, the substrate 102 optionally having a substrate bonding feature 109 thereon, and the infiltrant 104 positioned therebetween, collectively forming a precursor assembly, may be loaded into a refractory metal can and pressure transmitting medium and be subjected to HPHT bonding conditions substantially as any of those described herein. Upon application of elevated pressure and elevated temperature during HPHT bonding conditions, the infiltrant 104 at least partially melts and may carry the diamond seed material therewith. The infiltrated 104 may cause bonding between the substrate 102 to the PCD body 106 upon cooling, thereby forming the PDC 100. For example, if the PCD body 106 is at least partially leached, the infiltrant material may infiltrate into at least some of the interstitial spaces of the PCD body 106. If the PCD body 106 is unleached, the infiltrant 104 may not substantially infiltrate the PCD body 106 and the bonding between the PCD body 106 and the substrate 102 may be substantially at the interface therebetween.

The diamond seed material is present in the infiltrant 104 may aid in forming new diamond in the resulting PDC 100 at least at the interface between the PCD body 106 and the substrate 102 when the diamond seed material dissolves in the at least partially liquefied infiltrant material. If the substrate bonding feature 109 having PCD therein is present, diamond seed material present in the infiltrant 104 may enhance bonding between the diamond material in PCD body 106 and any diamond material in the substrate bonding feature 109 of the substrate 102 by increasing bonding therebetween.

In some embodiments, the carbide material in the substrate 102 may be partially leached (i.e., only a fraction of the cementing constituent is removed therefrom (e.g., only from the surface to an intermediate depth therein) by a process using less concentrated acid solutions or shorter soak times than described above (e.g., less than ½, ⅓, or ¼ as long a conventional PCD leaching process) to remove a portion of the cementing constituent (e.g., cobalt) therefrom. Subsequently, such partially leached substrates may be infused with boron, notably at the interfacial surface, to slow the flow of cobalt from the substrate 102 and/or the infiltrant 104 into the PCD body 106 during HPHT bonding. Boron may be infused into the cobalt-cemented tungsten carbide material heating the at least partially leached substrate in the presence of $B_4C$, SiC, graphite, and $KBF_4$. Temperatures suitable for infusing boron are about 850° C. and above, such as about 850° C. to about 1100° C., or about 1000° C. Heating times sufficient to infuse a cobalt-cemented tungsten carbide substrate include about 2 hours or more, such as about 2 hours to about 10 hours, about 40 hours to about 8 hours or about 6 hours. The resulting bonded PCD body 106 may have a smaller difference in the coefficient of thermal expansion ("CTE") throughout the PCD body 106 due to less cobalt being infiltrated therein during HPHT bonding. Thus, such a configuration may provide excellent thermal characteristics to the PDC during high temperature operations.

The infiltrant 104 may include a material suitable for forming new diamond, such as cobalt, iron, nickel, alloys of the foregoing. The infiltrant 104 may be in one or more forms such as a powder (e.g., grains or particles), a disc, a foil, or combinations of the foregoing. The infiltrant 104 may be thin enough such that the infiltrant is not discernable in the bonded product (i.e., the entire infiltrant melts and sweeps into the interstitial regions of adjacent PCD body and/or layer). The disk or foil may exhibit a thickness of about 20 μm or more, such as about 25 μm to about 750 μm, about 50 μm to about 500 μm, about 75 μm to about 300 μm, about 100 μm to about 200 μm, about 75 μm or more, about 100 μm or more, about 200 μm or more, or about 250 μm. The disk or foil may exhibit a thickness determined on proportion of the thickness of the PDC body 106. For example, the infiltrant comprising a disk or foil may exhibiting a thickness of about ⅛ of the thickness of the PCD body 106 or less such, about ⅛ the thickness of the PCD body 106 to about 1/128 the thickness of the PCD body 106, about ⅛ of the thickness of the PCD body 106, about 1/16 the thickness of the PCD body 106, about 1/32 the thickness of the PCD body 106, about 1/64 the thickness of the PCD body 106, or about 1/128 the thickness of the PCD body 106.

As noted above, the infiltrant 104 may include an infiltrant material in powder (i.e., granular or particle) form. For example, a thin layer of infiltrant powder may be placed on or adjacent to the interfacial surface 108 of the substrate 102 or a substrate bonding feature 109. The infiltrant 104 in powder form may exhibit thicknesses substantially similar to those discussed above for a disk or foil thickness. In some embodiments, the infiltrant 104 may also contain diamond seed material (e.g., material containing carbon). For example, diamond may nucleate and grow from diamond seed material provided by, but not limited to, dissolved carbon in liquefied infiltrant (e.g., liquefied cobalt) infiltrating into and/or to the PCD body being processed, partially graphitized diamond particles, carbon from a substrate, carbon from another source (e.g., graphite particles and/or fullerenes mixed with the diamond particles), or combinations of the foregoing. Diamond seed material may include single digit micron or smaller (e.g., sub-micron) diameter diamond particles; $sp^2$ hybridized carbon-containing particles such as graphite, fullerenes, carbon onions, or detonated diamond (i.e., diamond having an outer layer of $sp^2$ hybridized carbon over an inner layer of diamond); carbon ions, or combinations of the foregoing. In some embodiments, the diamond seed material may exhibit an average individual particle size of less than about 5 μm, or less than about 2 μm, such as about 5 nm to about 2 μm, about 10 nm to about 1 μm, about 50 nm to about 500 nm, about 100 nm to about 300 nm, about 2 μm, about 1 μm, about 500 nm, about 200 nm, about 100 nm, about 50 nm, or about 10 nm, or about the size of individual carbon atoms (i.e., carbon ions). More details about the types and amounts of $sp^2$-carbon-containing particles that may be employed are disclosed in U.S. Pat. No. 7,516,804; U.S. Pat. No. 7,841,428; and U.S. Pat. No. 7,972,397. U.S. Pat. No. 7,516,804; U.S. Pat. No. 7,841,428; and U.S. Pat. No. 7,972,397 are each incorporated herein, in their entirety, by this reference.

The amount of diamond seed material associated with an infiltrant may be present in a sufficiently small amount so that the infiltrant is not overwhelmed by the diamond seed material. Put another way, the diamond seed material may be present in an amount to ensure that substantially all of the diamond seed material associated with an infiltrant dissolves in the liquefied infiltrant. Additionally, the amount and distribution of the diamond seed material associated with the infiltrant may be controlled in order to limit uneven loading or distribution of diamond particles in one or more regions of the resulting PDC. In some embodiments, the diamond seed material may be present in and/or on the infiltrant 104 in an amount of about 10% by weight or less of the total infiltrant 104 including the diamond seed material, such as about 5% by weight or less, about 2% by weight or less, about 1% by weight or less, about 0.5% by weight or less, more than 0% by weight to about 10% weight, about 1% by weight to about 5% by weight, about 1% by weight, about 2% by weight, about 3% by weight, about 5% by weight, about 8% by weight, or about 10% by weight of the total infiltrant 104 including the diamond seed material therein. In an embodiment, the infiltrant 104 may include a cobalt disk infused with diamond particles exhibiting an average diamond particle size of less than about 2 μm, in an amount of about 5% by weight of the total weight of the infiltrant including the diamond seed material therein.

In some embodiments, the diamond seed material may be infused into or onto the infiltrant 104 using any number of methods including, but not limited to, one or more of high pressure compaction (e.g., pressing), roll compaction, carburization, paint, application of a tape or foil (e.g., high shear compaction tape), or chemical vapor deposition ("CVD") coating, of micron sized (e.g., about 1 μm to about 9 μm) or sub-micron sized diamond particles into or onto an infiltrant 104. Further, in the case of infiltrant including infiltrant powders, diamond seed material may be combined or otherwise associated with the infiltrant material by way of a ball mill, attritor mill, any other suitable mill, or combinations of the foregoing sufficient to mix the infiltrant material and the diamond seed material to achieve a substantially homogenous mixture of diamond seed particles in the infiltrant. In an embodiment, the infiltrant 104 may also contain cemented tungsten-carbide particles, such as cobalt-cemented tungsten carbide particles mixed therein.

In some embodiments, the diamond seed material in the form of carbon ions may be implanted into the infiltrant using plasma that includes carbon ions. Such carbon ions may be generated from a carbon-containing gas using electron cyclotron resonance ("ECR"), a large-area pulsed frequency, discharge of carbon-containing case, supper erosion of carbon electrode using a plasma. The generated carbon ions may then be accelerated at the infiltrant using a high-voltage source. Such accelerated carbon ions may be in the form of a high-energy beam of carbon ions. Suitable techniques for implanting carbon ions into an infiltrant are described in U.S. Pat. No. 8,080,071, which is incorporated herein, in its entirety, by this reference.

In an embodiment, upon application of HPHT conditions to the cell assembly containing the substrate 102, the PCD body 106, and the infiltrant 104 including the diamond seed material therein, the diamond seed material may dissolve in the at least partially molten infiltrant material and may be swept into the interstitial regions of the PCD body 106 with the infiltrant where the diamond seed material precipitates as new diamond grains in the PCD body 106 and/or at the interface between the PCD body 106 and the substrate 102. However, as previously discussed, in other embodiments, the infiltrant may not substantially infiltrate into the PCD body 106 and diamond may nucleate substantially at the interface between the substrate 102 and the PCD body 106. In embodiments where the interface includes a diamond-on-diamond interface, the diamond seed material may be used to increase or create bonding therebetween.

Figure 4A:
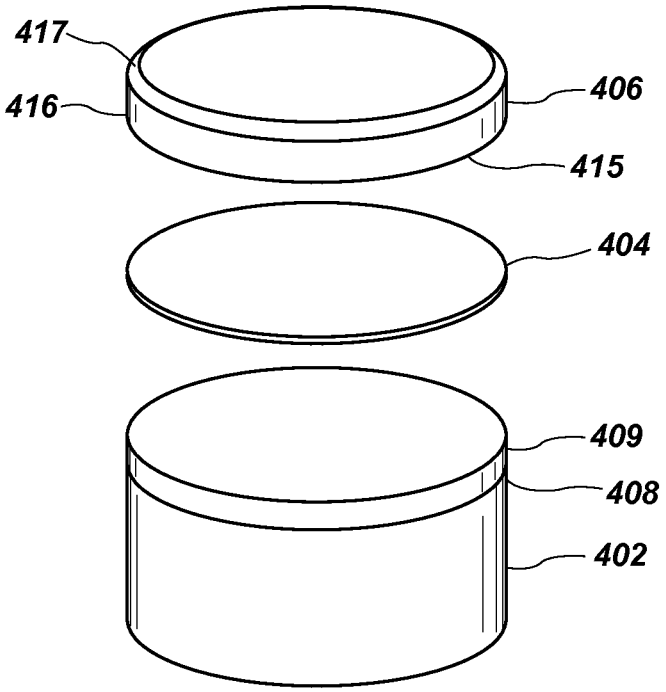
FIG. 4A is an exploded isometric view of an assembly for forming a PDC according to an embodiment.
Figure 4B:
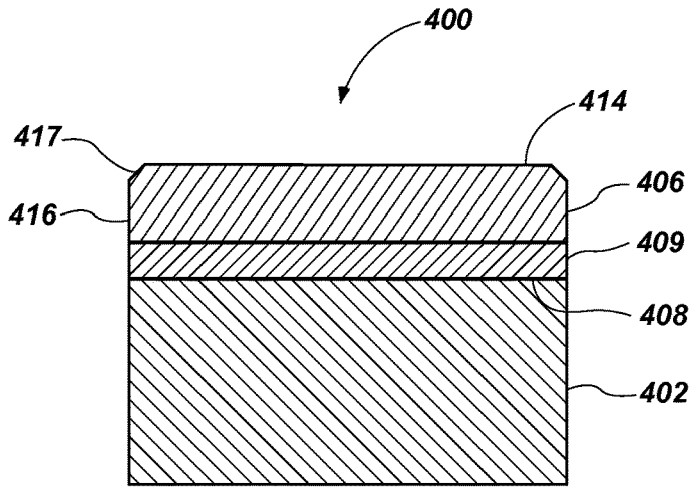
FIG. 4B is a side cross-sectional view of a PDC formed using the assembly of FIG. 4A.

In some embodiments, such as that illustrated in FIG. 4A, a PCD body 406 may be placed on top of an infiltrant 404 which sits atop a substrate 402, the infiltrant infiltrant 404 contacting the bonding surface 415 of the PCD body 406 and the interfacial surface 408 and/or the substrate bonding feature 409 of the substrate 402 in the resulting precursor assembly. FIG. 4B, illustrates the HPHT bonded PDC of the assembly illustrated in FIG. 4A, after bonding by any of the processes described herein. In embodiments such as those illustrated in FIGS. 4A-4D, the substrate 402 may include the substrate bonding feature 409 attached to or integrally formed in or on the substrate 402. The substrate bonding feature 409 may be formed in or on the substrate 402 at the interfacial surface 408. The substrate bonding feature 409 may be integrally formed on or bonded to the substrate 402 in a one-step HPHT sintering process substantially as described above, a two-step process including HPHT bonding substantially as described above, or a brazing process. The substrate bonding feature 409 may include at least one of at least one raised feature, at least one depression, a raised pattern in the interfacial surface 408, at least one material within or on the substrate 402, or combinations of the foregoing. The substrate bonding feature 409 may cover a portion of the substrate 402, an entire surface of the substrate 402 (e.g., the interfacial surface), or at least a portion of one or more surfaces of the substrate 402. For example, as illustrated in FIG. 4A, the substrate bonding feature 409 may include a PCD layer (e.g., a PCD table) extending across substantially the entire interfacial surface 408 of the substrate 402. Such a PCD layer may exhibit a thickness, as measured from the interfacial surface 408 of the substrate 402 outward of about 50 μm or more, such as about 50 μm to about 4 mm, about 100 μm to about 3 mm, about 500 μm to about 2 mm, about 1 mm or greater, about 1 mm to about 4 mm, about 200 μm, about 400 μm, about 1 mm, about 2 mm, about 3 mm, or about 4 mm.

The substrate bonding feature 409 including the PCD layer such as that illustrated at 409 may include sintered diamond particles bonded to the substrate 402. Diamond particles (i.e., diamond powder) suitable for use in the PCD layer forming at least a portion of a substrate bonding feature may include any of the diamond particles disclosed above, in any of the combinations or particle size distributions described above. It may be desirable that the PCD layer exhibit a different average diamond particle or grain size distribution than the average diamond particle or grain size distribution of the PCD body in order to provide for beneficial residual stresses in the resulting PDC or provide for a different or sufficient amount of infiltration into one PCD material over another.

The PCD layer comprising the substrate bonding feature 409 may be bonded to the substrate 402 in a one-step sintering process substantially as described above, a two-step process including HPHT bonding substantially as described above, or by brazing. In some embodiments, it may be desirable to leave the catalyst material in the PCD layer (i.e., an unleached PCD layer). For example, it may be desirable to leave the catalyst material (e.g., cobalt-containing metal-solvent catalyst) in the PCD layer in order to provide for bonding and/or complete dissolution of diamond seed material in the infiltrant 404 placed between the substrate 402 including the substrate bonding feature 409 and the PCD body 406. During HPHT bonding, the catalyst material from the PCD layer may at least partially melt and sweep into the interstitial spaces of the PCD body 406, thereby bonding the PCD layer and the substrate 402 attached thereto to the PCD body 406 upon cooling of the catalyst material therein. In some embodiments, the PCD layer may be at least partially leached of catalyst material prior to bonding to the PCD body 406 to the substrate 402. The corresponding PCD body 406 may also be at least partially leached prior to bonding or may be left unleached prior to bonding to the substrate 402. Further, embodiments of PDCs including a PCD body and a substrate including a substrate bonding feature comprising a polycrystalline diamond layer described below may have similar characteristics as the PDC and components thereof described above, such as by way of non-limiting example, PCD body and compositions thereof, substrate bonding feature including a PCD layer and compositions thereof, use of leaching of the PCD body and/or PCD layer including extent of leaching, use of an infiltrant including diamond seed material therein, and combinations thereof. In embodiments including an unleached PCD body and/or PCD layer, the infiltrant having diamond seed material therein may melt and dissolve the diamond seed material therein during HPHT bonding. The melted infiltrant having dissolved diamond seed material (i.e., carbon) may not infiltrate or only infiltrate on a limited scale into the mostly filled interstitial spaces of the unleached portions of the PCD body and/or PCD layer. In such embodiments, the dissolved diamond seed material in the melted infiltrant may facilitate bonding between the PCD body and the PCD layer.

Figure 4C:
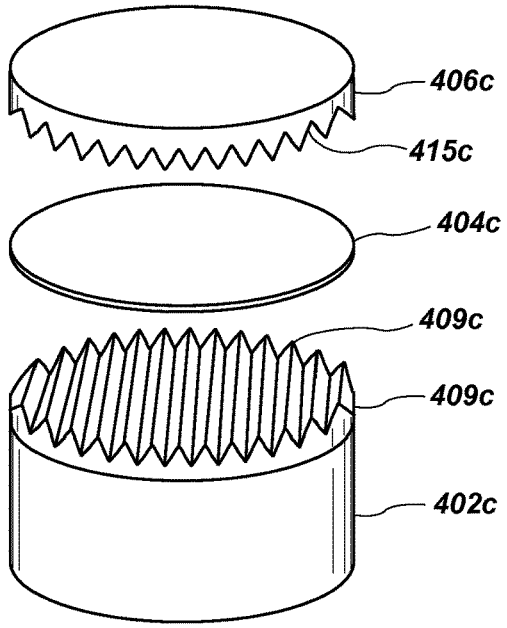
FIGS. 4C-4D are exploded isometric views of assemblies for forming PDCs according to embodiments.

In some embodiments, a substrate bonding feature 409*c* may exhibit a three-dimensional pattern (e.g., a raised or recessed pattern) formed in or on a substrate 402*c*, a PCD layer attached to the substrate 402*c*, or combinations of the foregoing. For example as illustrated in FIG. 4C, a raised three-dimensional pattern may be formed in and at least partially define the substrate bonding feature 409*c* comprising a PDC layer attached to the substrate 402*c*. Three-dimensional patterns may include a concave/convex pattern, grooved pattern as illustrated in FIG. 4C, a cross-hatched pattern, or combinations of the foregoing. Three-dimensional patterns may include any of the patterns described above extending in more than one direction. A generally corresponding three-dimensional pattern may be formed in the PCD body 406*c* at bonding surface 415*c* thereof to allow for mechanical interfacing/interlocking of the substrate bonding feature 409*c* at the interfacial surface and the bonding surface of the PCD body 406*c*.

Three-dimensional patterns may be formed in one or both of the substrate bonding feature of the substrate and the bonding surface of the PCD body using techniques including but not limited to electrical discharge machining (e.g., wire or sinker EDM), laser erosion, lapping, grinding, combinations thereof, or any other method suitable to form intricate patterns in polycrystalline diamond and/or substrate material.

The three-dimensional pattern between a substrate bonding feature 409*c* increases the surface area of the interface between the substrate 402*c* at the substrate bonding feature 409*c* and the bonding surface 415*c* of the PCD body 406*c*. For example, the three-dimensional pattern may be configured such that the surface area of the interface between the substrate bonding feature 409*c* and the bonding surface 415*c* is increased to more than 100% of the surface area of a flat interface between the same substrate bonding feature 409*c* and the bonding surface 415*c*. For example, the surface area may be increased to more than about 110% of the surface area of the flat interface between the substrate bonding feature 409*c* and the bonding surface 415*c*, such as about 110% to about 200%, about 120% to about 180%, about 130% to about 160%, or about 150% of the surface area of the surface area of a flat interface between the substrate bonding feature 409*c* and the bonding surface 415*c*. Such an increase in the surface area of the interface between a substrate bonding feature 409*c* and the bonding surface 415*c* may serve to improve mechanical characteristics of the bonding between the PCD body 406*c* and the substrate 402*c*.

In embodiments in which a three-dimensional substrate bonding feature (e.g., three-dimensional pattern) is used, the size and/or amount of the infiltrant 404*c* may be correspondingly increased to account for the increase in surface area between the substrate bonding feature and the bonding surface of the PCD body. For example, when a grooved pattern, such as that illustrated in FIG. 4C is formed in the substrate bonding feature 409*c* and the bonding surface of the PCD body 406*c*, the surface area of the infiltrant 404*c* may be correspondingly increased. For example, the area and/or thickness of a foil or powder infiltrant 404*c* may be increased based on the increased surface area of the interface between the PCD body 406*c* and the interfacial surface of the substrate 402*c* including the substrate bonding feature 409*c* thereon. In some embodiments, the amount of diamond seed material in or on the infiltrant may be increased to correspond to the increased surface area between the substrate bonding feature and the bonding surface of the PCD body. For example, the percentage increase in surface area of the interface between the substrate bonding feature and the bonding surface of the PCD body having a three-dimensional pattern therein over a flat interface between the same substrate bonding feature and the bonding surface of the PCD body, may directly correspond to a percentage increase in the surface area, thickness, diamond seed material content, or combinations of the foregoing, of the infiltrant used therebetween.

Figure 4D:
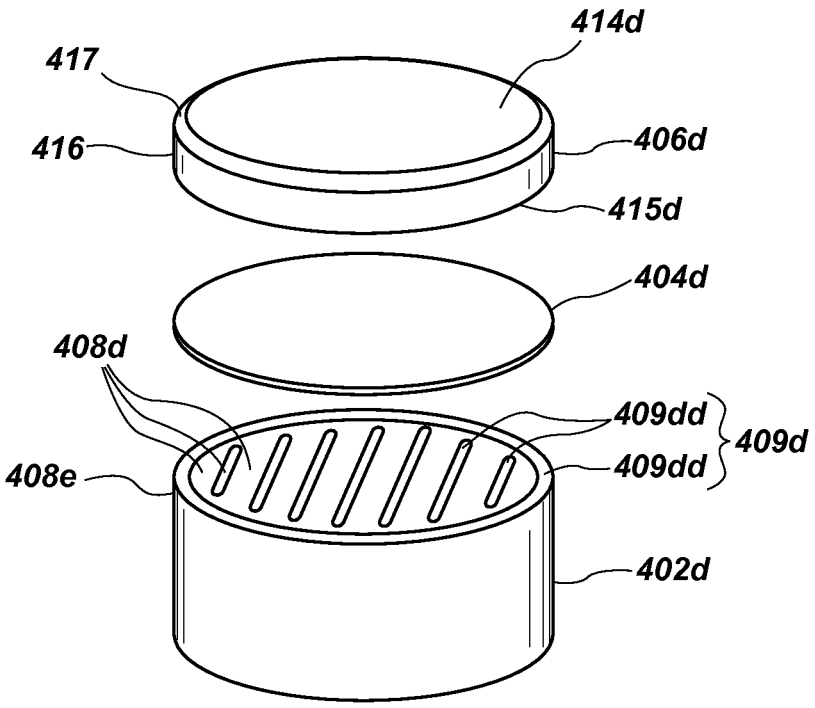

In an embodiment as illustrated in FIG. 4D and similarly in FIG. 3, a substrate bonding feature 409*d* may include one or more embedded PCD portions 409*dd* (i.e., PCD inlay(s)). The embedded PCD portions 409*dd* may extend a distance into the substrate 402*d* from the interfacial surface 408*d*. A surface of the embedded PCD portions 409*dd* may be substantially coplanar with the interfacial surface 408*d* or may protrude therefrom a selected distance. The embedded PCD portions 409*dd* may include sintered PCD material having bonded diamond gains exhibiting diamond-to-diamond bonding therebetween. The embedded PCD portions 409*dd* extend inward from the interfacial surface 408*d* of the substrate 402*d* to a selected depth therein. For example, the embedded PCD portion 409*dd* may extend 100 μm or more therein, such as about 100 μm to about 4 mm, about 200 μm to about 3 mm, about 500 μm to about 2 mm, about 1 mm or more, about 2 mm or more, or about 3 mm or more into the substrate 402*d* from the interfacial surface 408*d* thereof. The embedded PCD portion 409*dd* may be made by any of the PCD formation processes described herein (e.g., sintering conditions, and catalyst material use and amounts) and may be formed from diamond particles exhibiting any of the diamond particles sizes suitable for use in a PCD layer disclosed herein, in any of the combinations or particle size distributions described herein. The embedded PCD portion 409*dd* may be at least partially leached according to any suitable methods (e.g., as described herein) or may be unleached.

The embedded PCD portions 409*dd* may exhibit any number of geometries including, but not limited to, annular rings, bars, strips, cylinders, disks, spheres, dots, polyhedrons (e.g., cuboids, prisms, pyramids, etc.), any other suitable shape, or combinations of the foregoing. For example, the embedded PCD portion 409*dd* may exhibit a circular or disk-like geometry in substantially a center portion of the interfacial surface 408*d* of the substrate 402*d* extending a distance therein, similar to that illustrated in FIG. 3 at reference number 109. In an embodiment, a plurality of embedded PCD portions 409*dd* exhibiting any of the geometries disclosed above may include the substrate bonding feature 409*d*. For example, as illustrated in FIG. 4D, the plurality of embedded PCD portions 409*dd* may include a ring of PCD material embedded in the substrate 402*d* around an outer periphery 408*e* of the substrate 402*d*. The PCD material may have catalyst material (e.g., metal-solvent catalyst) therein (i.e. unleached), or may be at least partially leached. In some embodiments, the substrate bonding feature 409*d* may include at least one smaller concentric ring or a series of rings (e.g., decreasing in size). Any shape or size of a ring may include an embedded PCD portion 402*dd*. For the purposes of the above description, a "ring" as described herein may be circular or another shape, such as a square or triangular ring for example. In other embodiments, the substrate bonding features 409*d* may include one or more embedded PCD portions 409*dd* exhibiting a linear or bar geometry within the periphery of a substrate 402*d* at the interfacial surface 408*d* thereof, as illustrated in FIG. 4D.

A precursor assembly including the PCD body 406*d*, the substrate 402*d* having a plurality of embedded PCD portions 409*dd* therein, and the infiltrant 404*d* therebetween may be loaded into a pressure transmitting medium substantially similar to any disclosed herein. The infiltrant 404*d* may have diamond seed material infused therein and/or coated thereon. The precursor assembly may be loaded into an HPHT press and subjected to HPHT bonding conditions substantially similar to any of those described therein. Optionally, a peripherally extending edge chamfer 417*e* may be formed between the working surface 414*d* and the lateral surface 416*d* prior to or after bonding the PCD body 406*d* to the substrate 402*d*. A chamfer 417*d* may be formed using techniques including but not limited to electrical discharge machining (e.g., wire or sinker EDM), laser erosion, lapping, grinding, or any other method suitable to cut, machine, shape, or erode polycrystalline diamond material.

In embodiments including a substrate bonding feature comprising a PCD layer, such as any of those illustrated and described in FIGS. 4A-4D, the PCD layer may be leached or left unleached prior to HPHT bonding. In some embodiments, the PCD body may be leached or unleached prior to or after HPHT bonding. Leaching may be carried out on a PCD layer or PCD body prior to or after HPHT bonding, in any manner described herein.

In some embodiments, a catalyst free diamond powder volume and/or $sp^3$ and/or $sp^2$ carbon containing material (having no infiltrant and/or catalyst material therein), may be placed on top of an unleached PCD body prior to HPHT processing in order to pull catalyst material therefrom and allow a flow of catalyst material from a substrate and/or PCD layer into the PCD body for improved bonding of all of the PDC components. When an unleached PCD body is positioned on a substrate, a diamond powder volume positioned on top of the PCD body during HPHT bonding may substantially improve bond strength therebetween. A gradient of catalyst material, such as cobalt, may be exhibited in the resulting bonded PCD body and/or sintered diamond powder volume after such bonding. Such a method may be used with any of the PDCs described herein. A thickness of the catalyst-free diamond powder volume may be used or selected based on how much catalyst material is selected to be moved across the PCD body. Suitable thicknesses may include a diamond powder layer having a thickness of about 250 μm or more, such as about 250 μm to about 2 mm, about 500 μm to about 1 mm, about 500 μm, or about 1 mm. Suitable thicknesses may be about 1 percent to about 25 percent of the thickness of the PCD body, such as about 2 percent to about 10 percent of the thickness of the PCD body. The resulting sintered diamond powder layer on top of the PCD body may be surface finished for use as an additional PCD layer or may be removed by any one of grinding, lapping, EDM, lasing, machining, or other suitable technique to remove PCD material.

In some embodiments, the substrate bonding feature may include a raised portion (i.e. a protrusion) extending across less than the entire interfacial surface of the substrate and the PCD body may have a complementary cavity (i.e., a blind or through hole) cut or otherwise formed therein corresponding to the raised feature. The PCD body may be positioned to fit over (e.g., at least partially engage/interlock with) the substrate bonding feature comprising a raised portion to thereby provide a mechanical lock against lateral movement of the PCD body on the substrate and a greater bonding surface area between the PCD body and the substrate. For simplicity, the following substrate bonding features comprising raised portions discussed in relation to FIGS. 5A-7F are described as comprising the substrate material only. However, the substrate bonding features described below may be comprised of PCD, including a layer of PCD material, such as any of those disclosed above, and/or substrate material (e.g. cemented tungsten carbide) such as any of those described herein, or combinations of the foregoing. For simplicity, the following PDCs are described as being formed without an infiltrant therebetween. However, the following PDCs including a substrate bonding feature comprising a raised portion in FIGS. 5A-7F may be formed with or without using an infiltrant between the PCD body and the substrate.

Figure 5A:
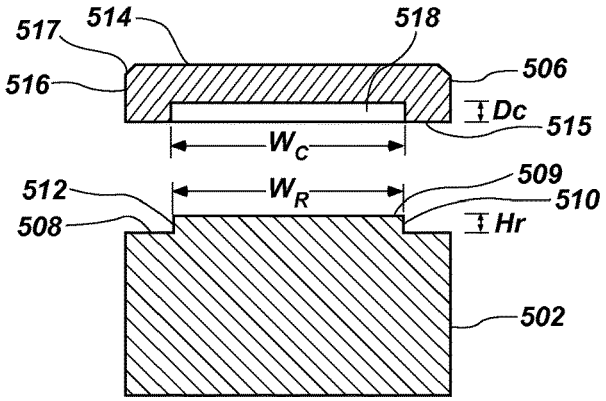
FIG. 5A is an exploded side cross-sectional view of an assembly for forming a PDC according to an embodiment.
Figure 5B:
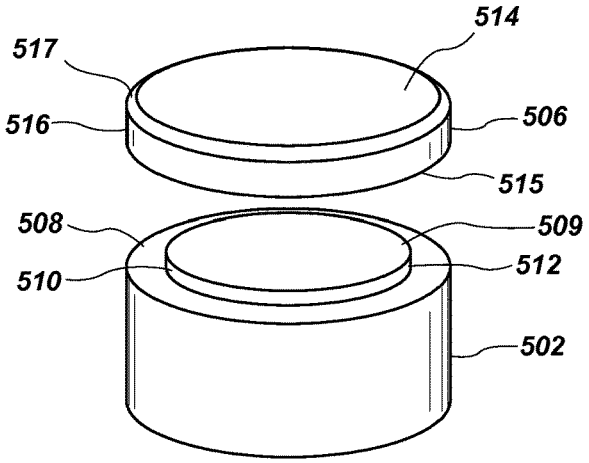
FIGS. 5B-5C are isometric views of the assembly of FIG. 5A at various steps in the process of making a PDC according to an embodiment.
Figure 5C:
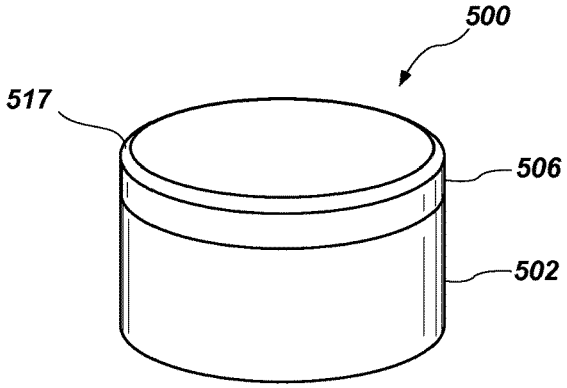

In an embodiment, such as that illustrated in FIGS. 5A-5C, a substrate 502 may include a substrate bonding feature 509 including a raised portion 510 protruding from at least a portion of an outer interfacial surface 508 of the substrate 502. For example, in FIGS. 5A and 5B, the substrate bonding feature 509 may be defined by the raised portion 510 protruding a height "Hr" from the outer interfacial surface 508 and one or more sidewalls 512 therebetween. The substrate bonding feature may include an upper surface extending between the one or more sidewalls. The substrate bonding feature 509 and the outer interfacial surface 508 may define a collective interfacial surface of the substrate 502. The substrate bonding feature 509 including the raised portion 510 protruding from the outer interfacial surface 508 may be generally centered about the center of the outer interfacial surface 508, or may be positioned off center from the center of the outer interfacial surface 508. FIGS. 5A and 5B illustrate a generally circular top surface shape (e.g., generally cylindrical 3-D shape) for the substrate bonding feature 509. However, the substrate bonding feature 509 may be in the form of any number of shapes including, but not limited to, the shapes and/or geometries described above for embedded PCD portions, with the distinction that the substrate bonding feature 509 of this embodiment may protrude from the outer interfacial surface 508 of the substrate 502.

A PCD body 506, HPHT sintered from any of the pluralities of diamond particles (e.g., diamond powders, diamond particle mixtures), including any of the diamond particle sizes or size distributions described herein, may include an upper, working surface 514; a bonding surface 515 generally opposite the working surface 514; a lateral surface 516 therebetween; and an optional chamfer 517 formed between the working surface 514 and the lateral surface 516. In some embodiments, the PCD body 506 may include a cavity 518 extending a depth "Dc" inwardly from the bonding surface 515. The cavity 518 may exhibit a complementary shape or geometry corresponding to the raised portion 510 defining the substrate bonding feature 509; such that the cavity 518 formed in PCD body 506 may fit over the substrate bonding feature 509 and allow the interfacial surface to contact the bonding surface 515.

Other suitable shapes, configurations, and materials for raised features include those described in U.S. Pat. No. 8,689,913 issued Apr. 8, 2014; and U.S. patent application Ser. No. 13/037,548 filed Mar. 1, 2011, each of which are incorporated herein, in its entirety, by this reference.

The PCD body 506 may be positioned over the substrate 502 so that the substrate bonding feature 509 fits inside of the cavity 518 and/or at least partially interlocks within the PCD body 506. Such a configuration may limit lateral movement of the PCD body 506 with respect to the substrate 502. The PCD body 506 and the substrate 502 may be subjected to HPHT bonding conditions, substantially similar to any described herein, so that infiltrant material present in the substrate adjacent the bonding surface 515 and the interfacial surface 508 (e.g., cobalt, iron, nickel, or combinations thereof) may at least partially melt and promote forming a bond between the substrate 502 and the PCD body 506 upon cooling.

The substrate bonding feature 509 in FIGS. 5A and 5B is illustrated with the at least one sidewall 512 exhibiting a substantially 90 degree angle relative to the outer interfacial surface 508. In other embodiments, the one or more sidewalls 512 may exhibit an angle between the sidewall 512 and the outer interfacial surface 508 of 90 degrees or greater, such as about 90 degrees to about 150 degrees, about 105 degrees to about 135 degrees, about 120 degrees, or about 135 degrees. The corresponding PCD body 506 may include a complementary angle in the cavity 518 therein effective to allow the PCD body 506 to fit over the substrate 502 including the substrate bonding feature 509 thereon.

The substrate bonding feature 509 including raised portion 510 is illustrated as having a height Hr from the interfacial surface 508. Suitable heights Hr may be more than about 500 μm or more, such as about 500 μm to about 12 mm, about 1 mm to about 10 mm, about 1.5 mm to about 8 mm, about 2 mm to about 6 mm, about 4 mm, about 1 mm, about 1.5 mm, about 2 mm, about 2.5 mm, about 3 mm, or less than about 5 mm. In some embodiments, the substrate bonding feature 509 comprising and defined by a raised portion may exhibit a height Hr of about 1/25 the total thickness of the PCD body 506 or more, such as about 1/25 to about the total thickness of the PCD body 506, about 1/20 to about 9/10 the total thickness of the PCD body 506, about 1/16 to about 3/4 the total thickness of the PCD body 506, about 1/10 to about 5/8 the total thickness of the PCD body 506, about 1/8 to about 1/2 the total thickness of the PCD body 506, about 1/5 to about 1/2 the total thickness of the PCD body 506, about 1/4 to about 1/3 the total thickness of the PCD body 506, or about 1/10, about 1/8, about 1/5, about 1/4, about 1/3, about 1/2, or about 3/4 the total thickness of the PCD body 506. The PCD body 506 having the cavity 518 complementary to the substrate bonding feature 509 exhibiting the raised portion having the height Hr substantially as any described above, may exhibit a complementary shape and depth Dc substantially the same as any of those heights Hr described above. In some embodiments, substantially all of the surfaces of the substrate bonding feature 509 and the cavity 518 are in contact with each other when the PCD body 506 having the cavity 518 therein is placed over the substrate 502 having the substrate bonding feature 509 comprising the raised portion thereon. For example, in FIG. 5C, the PDC 500 may be formed from the substrate 502 having the substrate bonding feature 509 comprising the raised portion exhibiting a height Hr of about 1/3 the thickness of the PCD body 506 as shown in FIGS. 5A and 5B. The PCD body 506 may have the complementary cavity 518 formed therein exhibiting a depth Dc of about 1/3 the thickness of the PCD body 506 as shown in FIGS. 5A and 5B. Upon positioning the PCD body 506 on the substrate 502, and subjecting the assembly to HPHT bonding conditions substantially similar to any of those described herein, the resulting PDC 500 may exhibit increased mechanical and bond strength between the PCD body 506 and the substrate 502 due at least in part to the increased surface area between the PCD body 506 and the substrate 502 and the geometry of the substrate bonding feature 509 and the cavity 518.

In some embodiments, the substrate bonding feature 509 including the raised portion 510 may exhibit a width "Wr" of about 5 mm or larger, such as about 5 mm to about 13 mm, about 6 mm to about 10 mm, about 7 mm to about 9 mm, about 6 mm, about 7 mm, about 8 mm, about 10 mm; or the width "Wr" may be about 1/25 or more of the total width of the PCD body 506, such as about 1/25 to about 9/10 the width of the PCD body 506, 1/10 to about 3/4 the width of the PCD body 506, 1/8 to about 2/3 the width of the PCD body 506, 1/5 to about 5/8 the width of the PCD body 506, 1/4 to about 1/2 the width of the PCD body 506, about 1/4, about 1/3, or about 1/2 the width of the PCD body 506. The corresponding PCD body 506 having the cavity 518 complementary to the substrate bonding feature 509 may have a width Wc exhibiting substantially similar widths as the substrate bonding feature width Wr.

In some embodiments, the cavity 518 may exhibit the width Wc slightly larger than the width "Wr" to provide a tighter or looser mechanical fit (e.g., a slip fit compared to a press fit), and/or in embodiments wherein an infiltrant is utilized, to provide an allowance or offset for the thickness of the infiltrant between the substrate 502 and the PCD body 506. The measure of the difference (i.e. distance) between the widths Wc and Wr may be characterized as an offset distance. A similar offset distance may be formed and used between the substrate bonding feature height "Hr" and the cavity depth "Dc," wherein the depth "Dc" may be slightly larger or smaller than the height "Hr." The offset distance may be about 25 μm or greater, such as about 50 μm to about 1 mm, about 100 μm to about 500 μm, about 200 μm to about 400 μm, about 50 μm to about 300 μm, about 50 μm, about 100 μm, about 20 μm, about 250 μm, or about 300 μm. In some embodiments, the offset may be increased to accommodate the thickness of the infiltrant between the substrate bonding feature 509 and the cavity 518.

While the substrate bonding feature 509 is referred to in many instances herein in the singular, In some embodiments, one or more substrate bonding features 509 each defined by one of the raised portions 510 may be formed and used on the substrate 502 in substantially the same manner, size, shape, or orientation as any of those described herein. Reductions in size and accommodations in shape and/or position of the substrate bonding features 509 comprising the raised feature may be made to fit more than one substrate bonding feature 509 in the outer interfacial surface 508 of the substrate 502. Complementary sizes, shapes and/or positions may be formed in the PCD body 506 (i.e. multiple cavities 518) to provide a complementary fit to the substrate 502 comprising one or more substrate bonding features 509 defined by the raised portion.

Figure 6A:
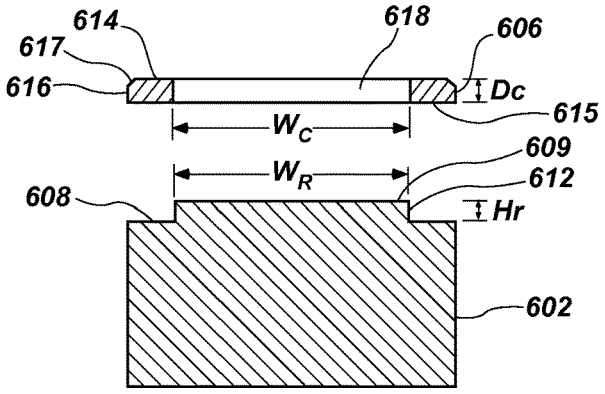
FIG. 6A is an exploded side cross-sectional view of an assembly for forming a PDC according to an embodiment.
Figure 6B:
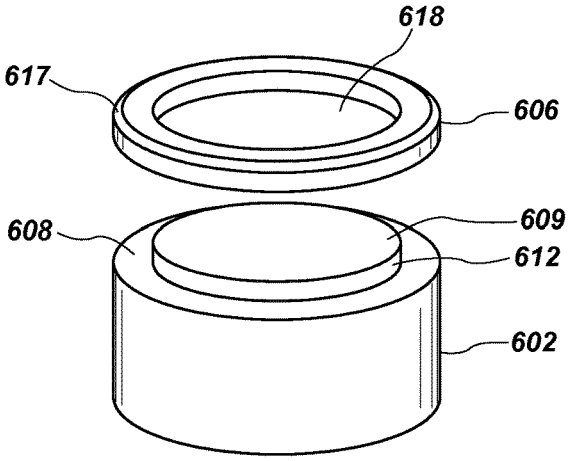
FIG. 6B-6C are isometric views of the assembly of FIG. 6A at various steps in the process of making a PDC according to an embodiment.
Figure 6C:
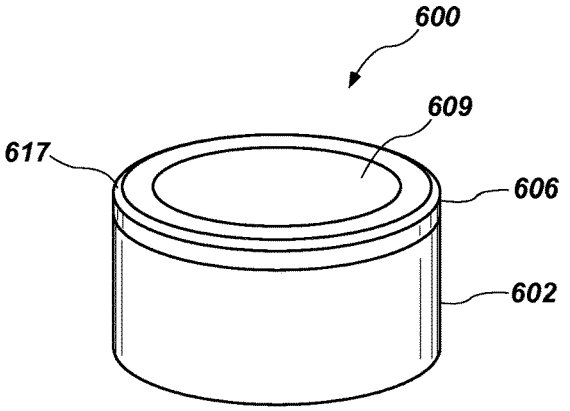

FIGS. 6A-6F illustrate embodiments of PDC's having a substrate 602, a substrate bonding feature 609 having a raised portion, a PCD body 606 having a cavity 618, and related features similar to that described above in FIGS. 5A-5C in which the raised portion of the substrate bonding feature 609 extends through the entire thickness of PCD body 606 so as to provide mechanical strength to the bond between the PCD body 606 and the substrate 602 and use less PCD material in the resulting PDCs. As illustrated in FIGS. 6A-6C, the thickness of the substrate bonding feature 609 including the raised portion may be about the same, less than, or more than the entire thickness of the corresponding PCD body 606. Thus, the corresponding cavity 618 in the PCD body 606 may have a depth Dc extending through the entire thickness of the PCD body 606, thereby defining a through-hole in the PCD body 606. For example, as shown in FIG. 6A-6C, the height Hr of the substrate bonding feature 609 including the raised portion may be equal to or greater than the thickness of the PCD body 606 and depth Dc of the cavity 618 formed therein. In such embodiments, when a bonding surface 615 of the PCD body 606 is placed on an outer interfacial surface 608 of the substrate 602, at least one sidewall 612 of the substrate bonding feature 609 including the raised portion may extend at least to a working surface 614 of the PCD body 606. The outer interfacial surface 608 and the substrate bonding feature 609 define a collective interfacial surface of the substrate. Optionally, a peripherally extending edge chamfer 617 may be formed between a lateral surface 616 and the working surface 614 of the PCD body 606.

The substrate bonding feature 609 including the raised portion of the substrate 602 and the cavity 618 formed in the PCD body 606 may exhibit substantially the same dimensions, shapes or geometries, placements, amounts, sidewall 612 angles and corresponding cavity angles, thicknesses (wherein the height Hr of the substrate bonding feature 609 is at least the thickness of the PCD body 606), and offset distances as any of those described above with respect to FIGS. 5A-5C.

While FIGS. 6A-6C illustrate the substrate bonding feature 609 having a generally cylindrical shape and the sidewall 612 exhibiting a generally perpendicular angle with respect to the working surface 614 of the PCD body 606 having the generally complementary cavity 618 (e.g., a through-hole) formed therein (e.g., which may be to at least restrict lateral movement of the PCD body 606 with respect to the substrate 602) which may add mechanical strength/durability to the bond therebetween when the PCD body 606 is positioned on or otherwise interlocked with the substrate. Further shapes for the substrate bonding feature 609 including the raised portion and corresponding cavity are disclosed hereinbelow. For example, non-cylindrical shapes for the substrate bonding feature 609 including the raised portion and the corresponding cavity 618 provide an increased surface area or desirable geometry at which the PCD body 606 and the substrate 602 may bond together may optionally restrict lateral movement of the PCD body 606 with respect to the substrate 602 and/or rotational movement may also be further restricted.

Figure 6D:
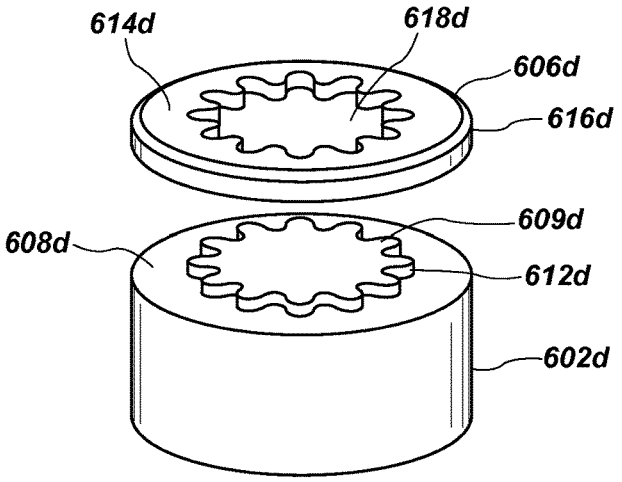
FIG. 6D is an exploded isometric view of an assembly for making a PDC according to an embodiment.
Figure 6E:
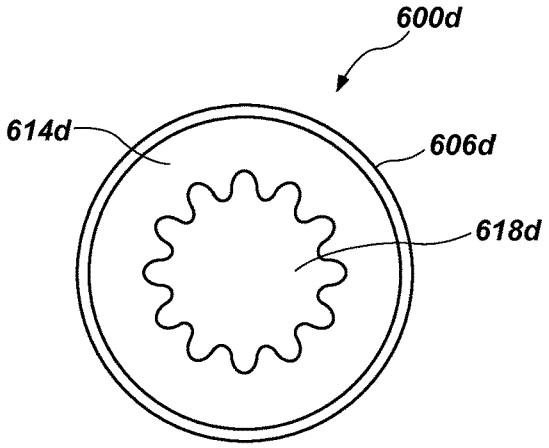
FIG. 6E is a top view of the PDC of FIG. 6D according to an embodiment.

For example, as illustrated in FIGS. 6D-6G, the substrate bonding feature 609*d* or 609*g* including the raised portion and the complementary cavity 618*d* or 609*g* may exhibit a substantially non-cylindrical or non-circular through-hole shape. As shown in FIGS. 6D and 6E, the shape of the substrate bonding feature 609*d* including the raised portion may be substantially non-circular and non-polygonal. For example, as shown in FIGS. 6D and 6E, the, rounded-gear shape of the a substrate bonding feature 609*d* including the raised portion and the complementary cavity 618*d* of the corresponding PCD body 606*d* may, provide increased surface area or a desirable geometry between the sidewall 612*d* of the substrate bonding feature 609*d* comprising the raised portion and the interior surface of the cavity 618*d*. Such a configuration may optionally restrict lateral and/or rotational movement of the PCD body 606*d* with respect to the substrate 602*d* when the PCD body 606*d* is placed onto the outer interfacial surface 608*d* of the substrate 602*d*. The substrate bonding feature 609*d* comprising the raised portion may extend to the working surface 614*d* of the PCD body 606*d*. While the lateral surface 616*d* of the PCD body 606*b* and the substrate 602*d* are illustrated as substantially cylindrical, In some embodiments, the substrate and the lateral surface 616*d* may be non-cylindrical, such as for example, polygonal (e.g., square, rectangular, trapezoidal, pentagonal, etc.), oval, non-circular and non-polygonal (i.e. rounded gear shape, oblong rounded polygonal shapes, and combinations of the foregoing.

Further shapes for the substrate bonding feature 609 including the raised portion and the complementary cavity 618 are contemplated. For example, as illustrated in top views of FIGS. 6F and 6G, the raised feature exhibiting a roughly cylindrical shape having indentations formed laterally therein may at least partially define the substrate bonding feature 609*f* or 609*g*. The indentations may exhibit substantially a dovetail/T-shaped shape (as illustrated), a squared shape, a polygonal shape, a chevron, a rounded shape, or combinations of the foregoing. Further, rather than an indentation, a substrate bonding feature having a raised portion may have protrusions extending laterally therefrom in substantially any of the shapes recited above. Indentations and/or protrusions may provide lateral and rotational restriction and larger bonding surface area as described above. The corresponding PCD bodies 606*f* and 606*g* may have a cavity 618*f* or 618*g* formed therein complementing the shape or geometry of the substrate bonding feature 609*f* or 609*g*, substantially as described with respect to any cavities described herein. Put another way, either one of or both of the substrate bonding feature 609*f* or 609*g* including the raised portion and the complementary cavity 618*f* or 618*g* formed in the PCD body 606*f* or 606*g* may exhibit indentations or protrusions laterally therefrom which correspond to a protrusion or indentation on the other (i.e., male-to-female or female-to-male).

Figure 6F:
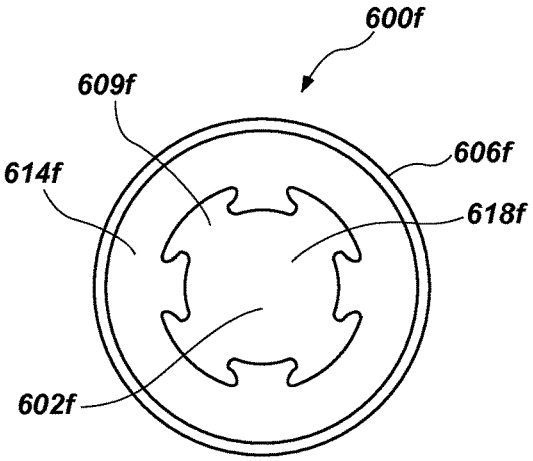
FIG. 6F is a top view of a PDC according to an embodiment.
Figure 6G:
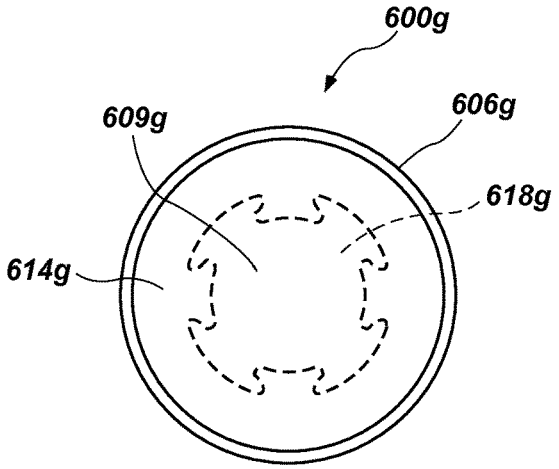
FIG. 6G is a top plan view of a PDC according to an embodiment.

As illustrated in FIG. 6F, the substrate bonding feature 609*f* having the raised portion may extend to the upper, working surface 614*f* of the PCD body 606*f*, and the corresponding PCD body 606*f* may have the cavity 618*f* formed therein, such that the cavity 618*f* extends through the entire thickness of the PCD body 606*f*. As illustrated in FIG. 6G, the same general shape may be exhibited by a substrate bonding feature 609*g* having a raised portion exhibiting a height less than the thickness of the PCD body 606*g*, such that the corresponding cavity 618*g* is also less than the total thickness of the PCD body 606*g*, wherein the working surface 614*g* is continuous and unbroken (i.e., no hole cut therethrough).

In some embodiments, a method of making a PDC such any of as those illustrated in FIGS. 6A-6G may include, providing or forming a substrate having at least a single substrate bonding feature including a raised portion protruding from the outer interfacial surface substantially as any described herein, and forming a PCD body including a configuration (e.g., shape and size) complementary to the substrate bonding feature such that the PCD body may fit on, over, and/or around the raised portion sufficient to allow contact (e.g., substantially continuous contact) of the outer interfacial surface of the substrate with the bonding surface of the PCD body. The method may include bonding the PCD body to the substrate by placing the PCD body adjacent to (e.g., over, on or around) the substrate bonding feature, and then subjecting the PCD body and the substrate to a bonding process including at least one of an HPHT bonding process or by brazing in any suitable manner. In an embodiment, an infiltrant, such as any described herein, may be placed between the PCD body and the substrate prior to bonding.

It may be desirable to disrupt the residual stresses in a PCD body and/or to create breaks in a PCD body to limit crack propagation or the transfer of stresses through a PCD body during operations. One of the benefits of such a PCD body is that breakage and/or damage may be contained to a specific region of a PCD body and a PDC having such a PCD body may be turned or rotated to utilize an undamaged portion of the PCD body. A PCD body including multiple segments may provide such benefits. Additionally, one or more damaged segments of a multiple segment PCD may be replaced after being damaged, such that the rest of the PDC may be utilized.

In some embodiments, the PCD body may include multiple PCD segments that are positioned adjacent to one another or fit together (i.e., circumferentially abut one another) to form a whole multiple segment PCD body. For example, FIGS. 7A-7E illustrate embodiments of PDCs 706 formed using multiple PCD segments 721-724 laterally (e.g., circumferentially) adjacent and/or abutting each other, that have been formed prior to association with the remaining segments therein or may be formed as a unitary whole and cut or partitioned prior to bonding to a substrate. The different segments may be formed using any of the methods for forming PCD bodies described herein, using any of the materials (i.e., diamond powders, catalysts, and infiltrants), amounts or proportions of materials, processes, and conditions described herein to form a PCD body. For example, the individual PCD segments 721-724 may be formed by making a PCD body in substantially the same manner as any described herein and then cutting the PCD body into distinct segments, or by forming individual pre-shaped segments of the PCD body separate from any other segments of the PCD body. PCD bodies, PCD segments and portions thereof may be cut, altered or otherwise shaped using known techniques such as plunge or wire EDM, lasing, lapping, milling, preformed molds, or grinding. The individual segments may be leached in a manner substantially similar to any described herein prior to assembly, or may remain unleached prior to assembly into a multiple segment PCD body. The individual PCD segments may include an upper, working surface; a lower, bonding surface; a first end; a second end; a peripheral surface (e.g., lateral or outer side surface of the multiple segment PCD body); and optionally an interior surface (e.g., an inner side surface defining a cavity or hole in an annular multiple segment PCD body) each similar to and positioned similarly as those same features described in relation to PCD bodies described herein. Each PCD segment may include interlocking features thereon. Each PCD segment may exhibit a configuration defining a portion of a cavity wherein the assembled multiple segment PCD body may collectively define a cavity therein, such as any of those described herein.

Figure 7A:
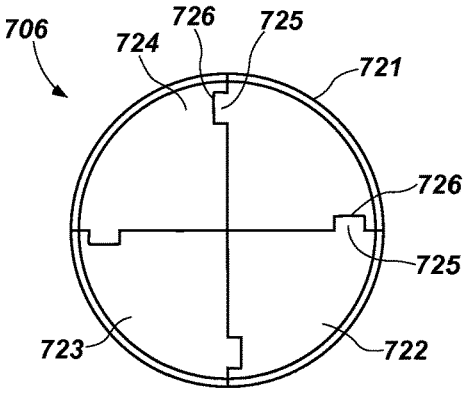
FIG. 7A is a top view of a PDC according to an embodiment.
Figure 7C:
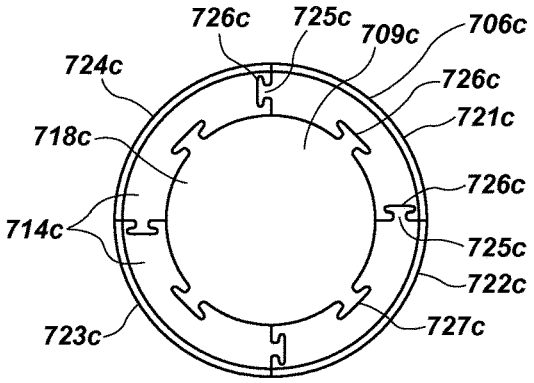
FIG. 7C is a top view of a PDC according to an embodiment.
Figure 7B:
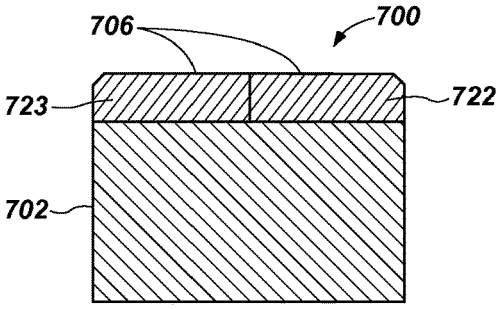
FIG. 7B is a side cross-sectional view of the PDC of FIG. 7A.
Figure 7D:
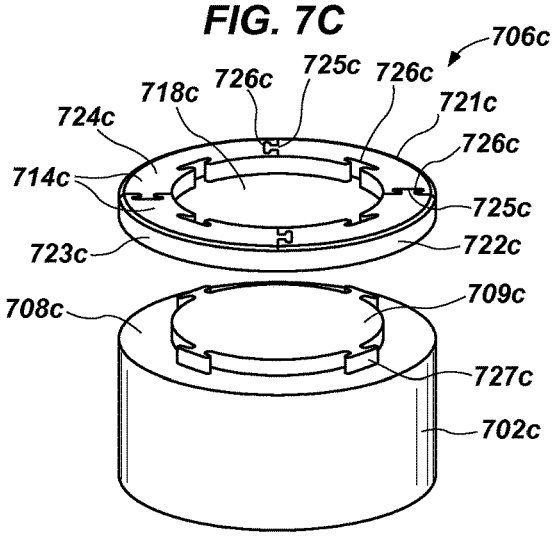
FIG. 7D is an exploded isometric view of an assembly for making the PDC of FIG. 7C according to an embodiment.

The segments may be in direct contact with or placed adjacent to one or more segments. The segments may interlock/abut with adjacent segments. Each PCD segment 721-724 may exhibit at least one segment interlocking feature 725 and/or 726 thereon configured to at least partially interlock one end of the segment with another end of the adjacent segment using either a protrusion or indentation. Each protruding segment interlocking feature 725 may exhibit one of many configurations (e.g., shapes and sizes) for the protrusion defining the protruding segment interlocking feature 725. Each indented segment interlocking feature 726 may exhibit one of many configurations (e.g., shapes and sizes) for the indentation defining the indented segment interlocking feature 726. The shape of the indentations and protrusions defining the segment interlocking features 725 and 726 may exhibit any shape suitable to provide mechanical interlocking between adjacent segments, such as a generally dovetail or T-shaped shape (as illustrated in FIGS. 7C-7D), a squared shape (as illustrated in FIGS. 7A-7B), a polygonal shape, a chevron, a rounded shape, or combinations of the foregoing. Each segment interlocking feature 725 and 726 on a PCD segment 721-724 may be formed such that the corresponding segment interlocking feature 725 or 726 on the next successive (e.g., adjacent) PCD segment 721-724 may have a complementary configuration (e.g., shape, size, position, geometry, etc.) to the segment interlocking feature 725 or 726 on the previous or subsequent PCD segment 721-724. For example, in FIGS. 7A and 7B, a first PCD segment 721 having an indented segment interlocking feature 725 having a squared shape may be used, wherein the corresponding protruding segment interlocking feature 726 on a second PCD segment 722 may have a corresponding shape and size such that when the two segments 721 and 722 are positioned adjacent to one another, the segment interlocking features 725 and 726 fit together to at least partially restrict movement of the segments with respect to each other. Each successive segment may fit in a similar manner until a whole multiple segment PCD body 706 is assembled. The PCD body 706 may be placed on a substrate where after a bonding process, substantially similar to any bonding process described herein is carried out, the PDC 700 is formed. The segmented PCD body 706 may limit the transfer of stresses and/or crack propagation induced during operations from one segment to another segment because of the discontinuities created by the individual PCD segments 721-724. In order to ensure proper engagement or fit between the PCD segments 721-724, an offset distance substantially as described above may be used between the segment interlocking features 725 and 726 on the PCD segments 721-724, and/or between the multiple segment PCD body 706 and the substrate 702. It will be appreciated that larger or smaller offsets may be utilized between adjacent segments to increase or decrease, crack propagation, residual stresses, durability, and/or interlocking between adjacent a segments.

Figure 7E:
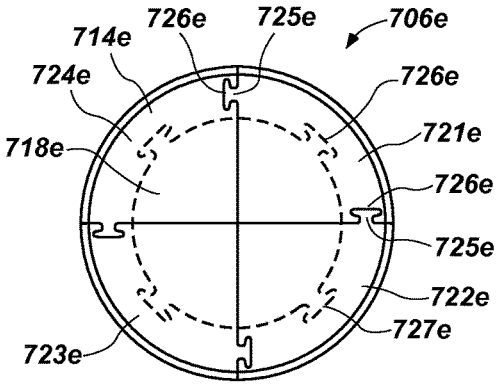
FIG. 7E is a top plan view of a PDC according to an embodiment.

In some embodiments, such as for example, those illustrated in FIGS. 7C-7E, a substrate 702*c* or 702*e* having a substrate bonding feature 709*c* or 709*e* including a raised portion may be used in combination with a multiple segment PCD body 706*c* or 706*e*, wherein the at least one of the individual segments interlock with the substrate bonding feature including a raised portion. Substantially any of the substrate bonding features in any of the configurations and compositions described herein may be used in combination with a multiple segment PCD body. For example, the substrate bonding feature 709*c* including the raised portion may be used when the raised portion includes at least one substrate interlocking feature 727*c* (e.g., lateral protrusions or indentations) similar in configuration to any segment interlocking described herein and configured to interlock with a complementary segment interlocking feature formed and/or disposed adjacent to the substrate interlocking feature 727*c*. As illustrated in FIGS. 7C and 7D, the substrate bonding feature 709*c* including a raised portion may include substrate interlocking features 727*c*, such as the dovetail/T-shaped (e.g., puzzle piece protrusions) protrusions extending laterally from the substrate bonding feature 709*c* including the raised portion, whereby the corresponding PCD body 706*c* may include complementary indented segment interlocking features 726*c* formed to at least partially interlock with the substrate interlocking feature 727*c* on the substrate bonding feature 709*c* including the raised portion. Alternatively, the substrate interlocking feature may include indentations formed in the raised portion defining the substrate bonding feature, and the corresponding PCD body may include complementary protruding segment interlocking features thereon formed to at least partially interlock with the indentation(s) in the substrate bonding feature. The substrate bonding feature 709*c* may extend from the outer interfacial surface 708*c* to a height substantially similar to any of the other heights described herein, such as a height equal to the entire thickness of the PCD body 706*c*, wherein the corresponding multiple segment PCD body 706*c* may be formed with or have a cavity 718*c* formed therein extending the entire thickness of the PCD body 706*c* such that the multiple segment PCD body 706*c* exhibits a generally annular geometry. The outer interfacial surface 708*c* and the substrate bonding feature 709*c* may define a collective interfacial surface. Upon placing the assembled multiple segment PCD body 706*c* comprising PCD segments 721*c*-724*c* including the segment interlocking features 725*c* and 726*c* thereon onto the outer interfacial surface 708*c* of the substrate 702*c*, the substrate bonding feature 709*c* comprising the raised portion and substrate interlocking feature 727*c* may extend the to the working surface 714*c* of the PCD body 706*c*. The outer interfacial surface 708*c* and the bonding surface may be placed in contact (e.g., substantially continuous contact) with each other, or optionally may include a infiltrant therebetween substantially as described herein, such that subsequent HPHT processing may bond the multiple segment PCD body to the substrate.

Figure 7F:
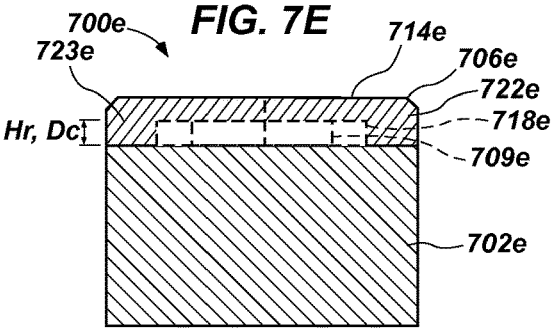
FIG. 7F is a side cross-sectional view of the PDC of FIG. 7E.

As illustrated in FIGS. 7E and 7F, a multiple segment PCD body 706*e* may be substantially similar to the multiple segment PCDs 706 and 706*c*. The multiple segment PCD body 706*e* may include segments 721*e*-724*e* each of which includes protruding interlocking features 725*e* and indented interlocking features 726*e*. In the embodiment illustrated in FIGS. 7E and 7F, a substrate 702*e* may include a substrate bonding feature 709*e* include a raised portion having substrate interlocking features 727*e*, collectively having a height Hr less than the total thickness of the PCD body 706*e*. The corresponding multiple segment PCD body 706*e* may include a cavity 718*e* formed therein exhibiting a depth Dc. In such an embodiment, the working surface 714*e* of the multiple segment PCD body 706*e* may be substantially continuous and planar (i.e. no cavity formed at the working surface such as in FIGS. 7C and 7D) except the divisions between segments. In some embodiments, a substrate bonding feature may include a raised portion having a height equal to the total thickness of the PCD body, the raised portion may include substrate interlocking feature thereon, the substrate interlocking features exhibiting a height less than that of the thickness of the PCD body. A complementary cavity may be formed in a corresponding PCD body, such as a multiple segment PCD body as described above.

While embodiments of multiple segment PCD bodies 706 have been described herein without a infiltrant used between the substrate an the PCD body, in some embodiments, a infiltrant, substantially similar to any of those described herein, may be used between the multiple segment PCD body and the substrate, and/or between individual segments of the multiple segment PCD body. In embodiments in which a infiltrant is used between the multiple segment PCD body and the substrate (including a substrate bonding feature thereon) and/or between the segments in the multiple segment PCD body during HPHT bonding substantially as any of the HPHT bonding processes describe herein, an offset distance substantially similar to the offset distance described above may be used between the multiple segment PCD body and the substrate (including a substrate bonding feature thereon) and/or between the segments in a multiple segment PCD body in order to provide for a satisfactory engagement, bonding, and/or infiltration between parts. Similarly, offsets such as those described herein may be used in embodiments whereby the multiple segment PCD body and the substrate, and/or individual segments of the multiple segment PCD body are brazed together with suitable braze alloys, such as when Ticusil or another carbide forming braze material is used as a braze alloy between the parts.

In some embodiments, individual segments in a multiple segment PCD body may exhibit differing compositions and/or properties compared to adjacent segments, such as different average diamond grain sizes, different amounts and/or types of catalyst and/or infiltrant materials therein, and/or formation by differing HPHT processes. Individual segments may be formed using any of the materials or material proportions described herein (e.g., diamond particle sizes, grain sizes, modes, catalyst materials and amount, presence and composition of any infiltrant materials), and any of the process conditions described herein (e.g., sintering temperature, sintering pressure, infiltrant use, leaching use and conditions, etc.).

In some embodiments, a method of making a PDC such any of as those illustrated in FIGS. 7A-7F may include providing or forming a substrate having at least one substrate bonding feature including a raised portion protruding from the interfacial surface substantially as any of those described herein, including but not limited to those describing optional interlocking features; and forming a multiple segment PCD body including, providing or forming individual segments of the multiple segment PCD body each including an upper, working surface; a lower, bonding surface; a first end; a second end; an outer side; and optionally, interlocking features such as any of those described therein, by any of the methods described herein. The method may include positioning each of the plurality of segments to at least partially engage/abut an adjacent segment at an end thereof to thereby form the assembled multiple segment PCD body (e.g., a collective or whole PCD body). The positioning may be done prior to or substantially contemporaneously with positioning the PCD body on the substrate, which may include interlocking any interlocking features thereon. The assembled multiple segment PCD body may form a collective body exhibiting a configuration (e.g., cavity, shape, and size) complementary to the substrate bonding feature such that the assembled multiple segment PCD body may fit on, over, and/or around the raised portion sufficient to allow contact (e.g., substantially continuous contact) of the interfacial surface of the substrate with the bonding surface of the assembled multiple segment PCD body. The method may include bonding the assembled multiple segment PCD body to the substrate by positioning the assembled multiple segment PCD body adjacent to (e.g., over, on, and/or around) the substrate bonding feature. Such a configuration may create a substantially continuous interface between the interfacial surface of the substrate and the bonding surface of the PCD body thereby interlocking the PCD body sufficient to limit at least one of lateral and rotational movement of the PCD body with respect to the substrate. Further, such an assembly may then be subjected to a bonding process including at least one of an HPHT bonding process or brazing in any manner described herein. In some embodiments, an infiltrant, such as any described herein, may be placed between the PCD body and the substrate prior to bonding. In some embodiments, a method of making a multiple segment PDC may include replacing one or more PCD segments of the multiple segment PDC (e.g., after they become damaged during use) using any of the techniques disclosed above, such as PCD formation, shaping, bonding, positioning, or combinations of the foregoing.

Figure 8A:
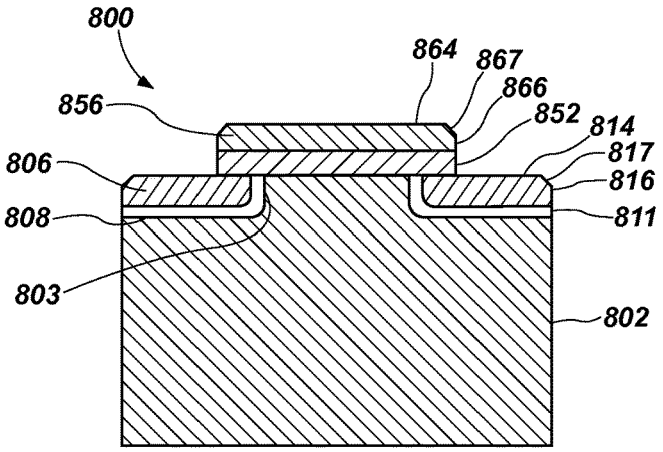
FIG. 8A is a side cross-sectional view of PDC according to an embodiment.
Figure 8B:
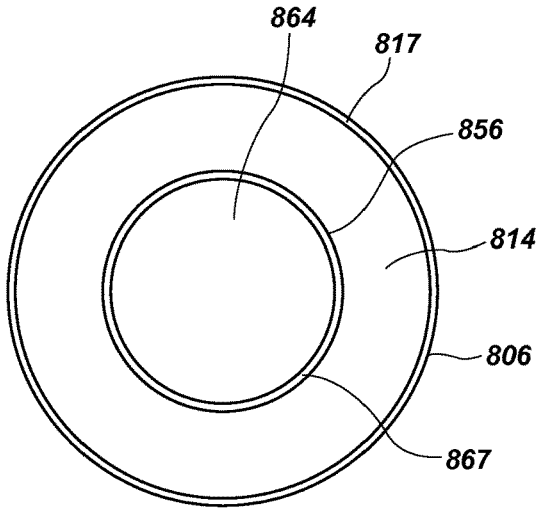
FIG. 8B is a top view of the PDC of FIG. 8A or 8C.
Figure 8C:
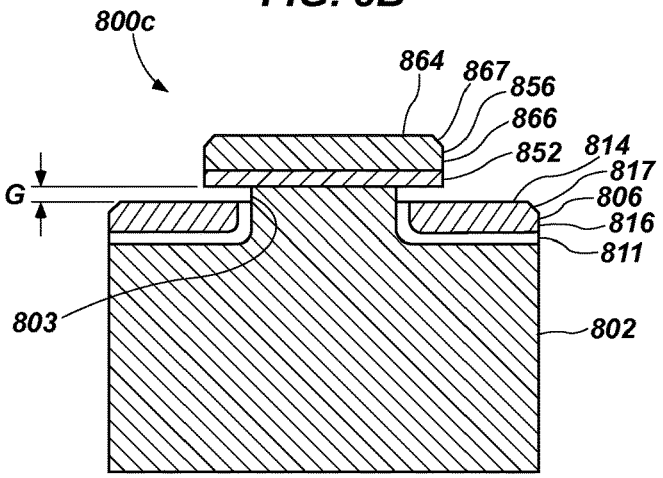
FIG. 8C is a side cross-sectional view of a PDC according to an embodiment.

As illustrated in FIGS. 8A-8C, multi-tiered PDCs 800 or 800*c* may be formed using an annular PCD body 806 bonded to a substrate 802 optionally having a material layer 811 therebetween. A raised portion 803 of the substrate 802 may extend through the annular PCD body 806 to at least the height of a working surface 814 thereon. The raised portion 803 may be substantially similar to a substrate bonding feature which extends a height from the interfacial surface of the substrate, such as any described herein. An upper PCD body 856 is bonded to an upper substrate 852, and the upper substrate 852 may be bonded to the substrate 802 at the surface of the raised portion extending through the annular PCD body 806.

In an embodiment, the upper PCD body 856 may be bonded directly to the raised portion 803 of the substrate 802 (i.e., the upper substrate 852 is omitted). The annular PCD body 806 may include the working surface 814, a lateral surface 816, and an optional chamfer 817 therebetween. Likewise, the upper PCD body 856 may include a working surface 864, a lateral surface 866, and an optional chamfer 867 therebetween. The annular PCD body 806 and the upper PCD body 856 may be formed in substantially the same manner using substantially the same materials as any of the PCD bodies described herein including material composition (e.g., diamond powder sizes and modes, and catalyst materials and amounts), material amount or proportion, dimensions, HPHT sintering process conditions, leaching conditions, or combinations thereof. In some embodiments, the annular PCD body 806 and the upper PCD body 856 may be at last partially leached or may remain unleached prior to assembly into the multi-tiered PDC 800 or 800*c*. The upper PCD body 856 and, when used, the upper substrate 852 may exhibit at least one larger lateral dimension (e.g., larger diameter) than the raised portion of the substrate 802, the lateral dimension being sized and configured effective to retain (at least by a partial overlap) the annular PCD body 806 on the substrate 802 upon bonding the upper PCD body 856 to the raised portion 803 of the substrate 802. For example, the larger lateral dimension of the upper substrate 852 and/or the upper PCD body 856 may extend a lateral distance of 250 μm or more beyond the outer surface of the raised portion 803 of the substrate 802, such as about 500 μm to about 5 mm, about 1 mm to about 4 mm, about 2 mm to about 3 mm, about 2.5 mm, about 1 mm, about 500 mm, or about 250 mm. The upper substrate 852 may be configured to exhibit substantially the same or a different geometry (e.g. shape, size, lateral dimensions) as the upper PCD body 856.

In some embodiments, the substrate 802 may include a raised portion 803 extending from and to a height above the interfacial surface 808 of the substrate 802. The raised portion 803 may be substantially similar in composition, size (including height and width), shape, position, or combinations of the foregoing as any of the substrate bonding features 509, 609 or 709 having a raised portion thereon as described herein with respect to FIGS. 5A-7F. In some embodiments, the raised portion 803 may exhibit a height substantially equal to or greater than the height of the working surface 814 of the annular PCD body 806 positioned on the interfacial surface 808 (conversely, the annular PCD body may have a working surface extending a height about the same, more than, or less than the height of the raised portion. The raised portion 803 of the substrate 802 may be bonded to the upper substrate 852 at the top of the raised portion 803 using any technique suitable for bonding carbide to carbide or a PCD to carbide, such as sintering or brazing.

In some embodiments, the material layer 811 may include a bushing or impact resistant (e.g., impact damping) material such as but not limited to, a PCD material containing at least one low-carbon-solubility material such as copper or tin as disclosed in U.S. application Ser. No. 13/027,954 which is incorporated herein, in its entirety, by this reference; non-PCD materials such as a refractory metal material (e.g., tungsten, niobium, molybdenum, vanadium, alloys thereof, or other suitable material; or other suitable impact dampening materials. For example, the material layer 811 may include any barrier materials and processes disclosed in U.S. Pat. No. 7,971,663, which is incorporated herein, in its entirety, by this reference. In embodiments including the material layer 811, the annular PCD body 806 may be bonded to the material layer 811 using any of the bonding techniques described herein, including, but not limited to HPHT bonding, brazing, and adhesion using an adhesive such as an epoxy or other suitable adhesive.

In an embodiment, the annular PCD body 806 may freely rotate around the raised portion 803. In such embodiments, the annular PCD layer may not be bonded to the substrate 802 and/or the upper substrate 852 may not be in contact with the annular PCD body 806. In embodiments, such as 800*c* in which the upper substrate 852 is not in contact with the annular PCD body 806, the upper substrate may be spaced from the annular PCD body 806 by a distance "G," as shown in FIG. 8C, defined by the distance between the working surface 814 of the annular PCD body 806 and the bottom of the upper substrate 852 as spaced therefrom by the raised portion 803. The distance "G" may be about zero to about 2 mm, such as about 100 μm to about 1.5 mm, about 200 μm to about 1 mm, about 25 μm, about 250 μm, about or about 500 μm.

While the working surface 864 of the upper PCD body 856 is illustrated as substantially planar, In some embodiments, the upper, working surface 864 may be substantially non-planar exhibiting by way of non-limiting example, a domed geometry, a polygonal geometry, a patterned geometry (e.g., stippling), or combinations of the foregoing. When the upper PCD body 856 exhibits a domed geometry, the upper PCD body 856 may act as an engagement limiter, which may prevent excessive depth of cut and the resulting forces therefrom. A domed geometry may also minimize bit damage if the annular PCD body 806 were to break prematurely.

In some embodiments, the raised portion 803 and/or corresponding annular PCD body 806 may be configured in to include and shape, size, and/or interlocking features described herein. In some embodiments, the annular PCD body 806 may include multiple segments similar to any described herein.

Figure 8D:
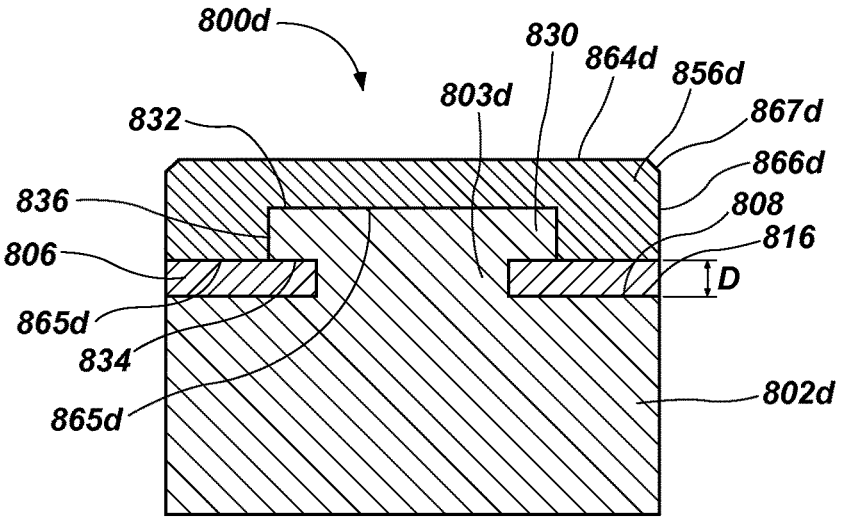
FIG. 8D is a side cross-sectional view of a PDC according to an embodiment.
Figure 8E:
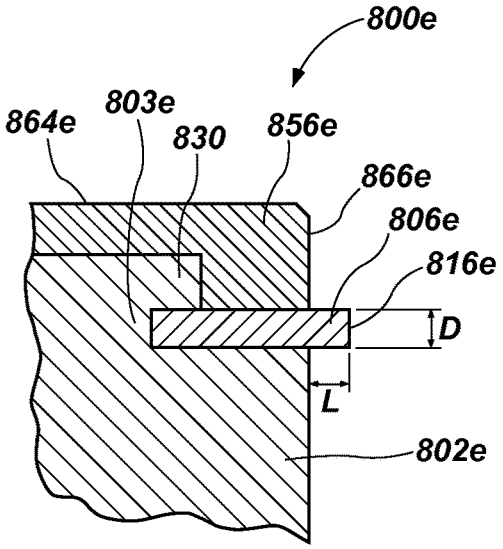
FIG. 8E is a side cross-sectional view of portion of a PDC according to an embodiment.

In some embodiments, a multi-tiered PDC may include a substrate having an upper portion with a flange extending therefrom. Such embodiments may be substantially similar to those described above with respect to PDCs 800 and 800*c*. In some embodiments, a multi-tiered PDC may include an upper PCD body that extends laterally to the outer surface of the substrate. FIGS. 8D and 8E show multi-tiered PDCs 800*d* and 800*e* in which the substrate 802*d* includes a raised portion 803*d* extending a height from an interfacial surface 808. The raised portion 803 may include a flange 830 extending laterally therefrom, with the flange 830 being spaced a distance D from the interfacial surface 808. The flange 830 may be positioned at a distal end of the raised portion 830. In an embodiment, the flange 830 may extend laterally around the entire raised portion 803*d*. In another embodiment and as explained in more detail below, the flange 830 may extend around only a section or sections of the raised portion 803*d*. The flange 830 may have an upper surface 832, a lower surface 834, and a lateral surface 836 extending therebetween.

The multi-tiered PDC 800*d* may include the annular PCD body 806, substantially as described above and having an outer surface 816. The annular PCD body 806 may be integrally formed on and with the substrate 802*d*, or the annular PCD body 806 may be performed, and the preformed PCD body 806 may be a multiple segment PCD as disclosed herein that may be assembled around the raised portion 803*d*, positioned under the flange 830. For example, the annular PCD body 806 may exhibit a height equal to or less than the distance D, and the raised portion 803*d* including the flange 830 may extend a height above (and over at least a portion of) the annular PCD body 806. In this manner, the flange 830 may help retain the annular PCD body 806 therebelow. The annular PCD body 806 may extend laterally to the periphery of the substrate 802*d*.

The multi-tiered PDC 800*d* may include an upper PCD body 856*d*. The upper PCD body 856*d* may include a working surface 864*d*, a bonding surface 865*d*, and a lateral surface 866*d* therebetween. The upper PCD body 856*d* may include a chamfer 867*d* extending between the working surface 864*d* and the lateral surface 866*d*. The bonding surface 865*d* may include a configuration (e.g., geometry) complementary to that of the raised portion 803*d* extending above the annular PCD body 806. The upper PCD body 856*d* may be attached or affixed (e.g., bonded) to the substrate 802*d* at the upper surface 832 and/or lateral surface 836 of the flange 830, by any suitable method such as those described herein. The upper PCD body 856*d* may or may not contact the annular PCD body 806. The upper PCD body 856*d* in contact with the annular PCD body 806 may be bonded to the annular PCD body 806 by any suitable method for bonding PCD to PCD, such as those described herein.

The annular PCD body 806 may be spaced from the interfacial surface 808 of the substrate 802*d* by an material layer, such as any material layer described above with respect to PDCs 800 and 800*c*. In an embodiment, the annular PCD body 806 may extend a height less than the distance D, and the annular PCD body 806 may also remain unbonded to the substrate 802*d* (e.g., the annular PCD body 806 may freely spin about the raised portion 803*d*). In an embodiment, the annular PCD body 806 may be separated from the upper PCD body 856*d* by a material layer such as any described herein.

In an embodiment shown in FIG. 8E, a multi-tiered PDC 800*e* may include an annular PCD body 806*e* and a substrate 802*e*. The substrate 802*e* may be substantially similar to substrate 802*d* described above (e.g., including a raised portion 803*e* having a flange 830 extending laterally therefrom). The upper PDC 856*e* may be substantially identical to the upper PCD body 856*d* described above, including a working surface 864*e* and a lateral surface 866*e*. The annular PCD body 806*e* may be substantially similar to any annular PCD body described herein and may include a lateral surface 816*e* extending laterally beyond the outer periphery of the substrate 802*e* a distance "L". The distance L may be about 10 μm or more, such as about 10 μm to about 7.5 mm, about lmm to about 5 mm, or about 3 mm.

Figure 8F:
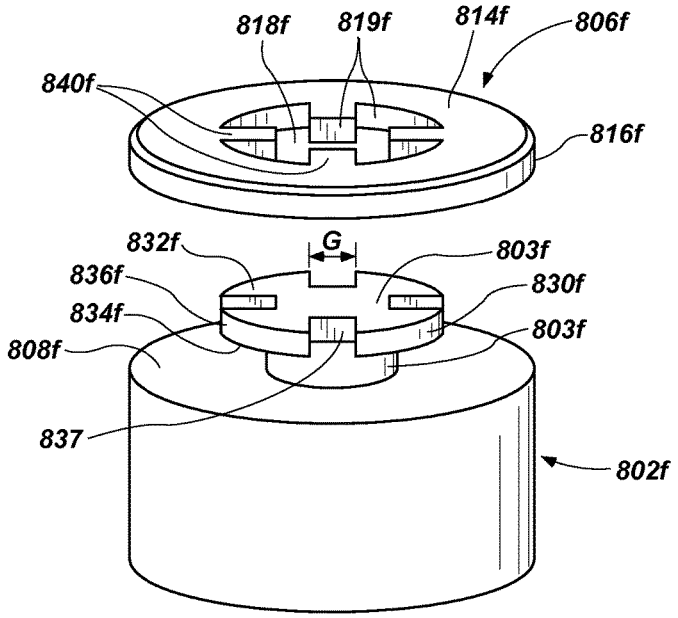
FIG. 8F is an exploded isometric view of a substrate and PCD body assembly according to an embodiment.
Figure 8G:
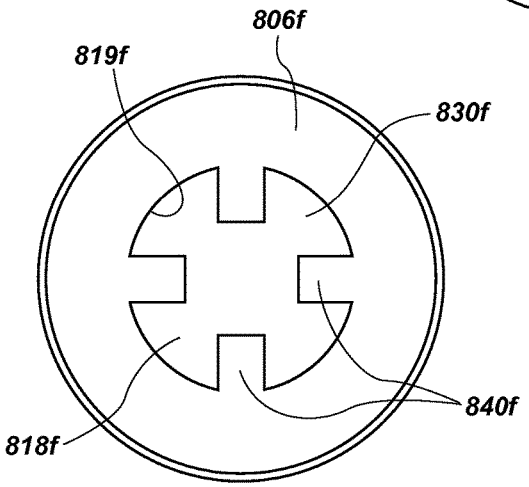
FIG. 8G is top elevation view of the PCD body of FIG. 8F.
Figure 8H:
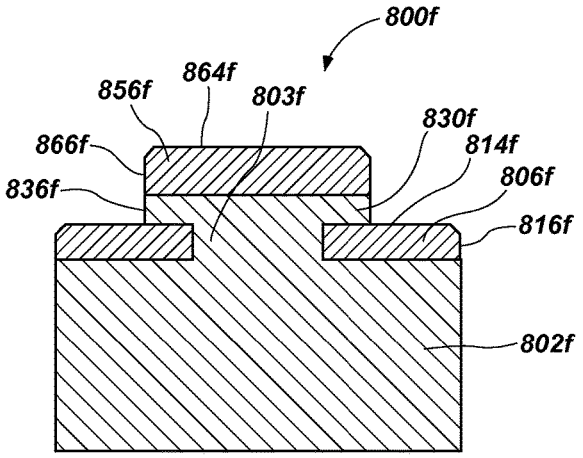
FIG. 8H is a side cross-sectional view of a PDC made using the assembly of FIG. 8F, according to an embodiment.

In an embodiment as shown in FIGS. 8F-8H, a multi-tiered PDC 800*f* may include a substrate 802*f* having raised portion 803*f* with a flange 830*f* extending laterally therefrom. The multi-tiered PDC 800*f* further includes an annular PCD body 806*f* exhibiting a geometry complementary to the flange 830*f*. The raised portion 806*f* including the flange 830*f* may be substantially similar to the raised portion 803*d* or 803*e* and the flange 830. The flange 830*f* may be interrupted or only extend around discrete sections of the raised portion 803*f*. For example, as shown in as shown in FIGS. 8F-8H, the flange 830*f* includes an upper surface 832*f*, a lower surface 834*f*; and a lateral surface 836*f* extending therebetween. The flange 830*f* may extend laterally (e.g., radially) from the raised portion 803*f* in one or more (e.g., two, three, four or more) discrete sections. The discrete sections may have a gap 837*f* therebetween, with the gap 837*f* defined between adjacent sections of the flange 830*f* and exhibiting a distance "G." The distance G be may be about 1 mm or more, such as about 1 μm to about 13 mm, about 2 μm to about 10 mm, about 3 mm to about 7 mm, or about 5 mm. The shape of the geometry of the sections of the flange 830*f* may define a substantially squared gap, a substantially dovetailed/T-shaped gap, a chevron shaped gap, a rounded gap, or combinations of any of the foregoing.

The annular PCD body 806*f* may exhibit a geometry substantially complementary to the raised portion 803*f* including the flange 830*f* For example, the annular PCD body 806*f* may include a cavity 818*f* sized and configured to allow the annular PCD body 806*f* to receive and fit over the raised feature 803*f* including the flange 830*f* having discrete sections. The cavity 818*f* may be defined by an interior surface 819*f* of the annular PCD body 806*f* extending between a working surface 814*f* and a bonding surface thereof. The interior surface 818*f* defines an inner periphery of the annular PCD body 806*f* generally opposite the lateral surface 816*f* that extends about the outer periphery of the annular PCD body 806*f* The cavity 818*f* may be further defined by one or more protrusions 840*f* sized and configured to fit between the sections of the flange 830*f* For example, the one or more protrusions 840*f* may extend inwardly a distance toward the center of the cavity 818*f*. In an embodiment, the one or more protrusions 840*f* may be sized and configured to match the geometry of the gap 837*f* such that there is only enough clearance for the one or more protrusions 840*f* to slide down through the gaps 837*f* yet still have a sufficient amount of material to mechanically secure/hold the annular PCD body 806*f* under the flange 830*f* when the annular PCD body 806*f* is lowered and twisted into a position whereby the flange 830*f* is directly over the one or more protrusions 840*f*. In some embodiments, there may be an offset between outer shape of the raised portion 803*f* including the flange 830*f* and the interior surface 819*f* including any of the one or more protrusions 840*f* thereon. The offset distance may be substantially similar to any described herein.

An upper PCD body 856*f* may be bonded to the upper surface of the raised portion 803*f* (e.g., the upper surface 832*f* of the flange 8300 by any technique disclosed herein, such as being formed integrally with the raised portion 803*f* via HPHT sintering diamond powder thereon, or brazing or HPHT bonding a preformed PCD body that may be leached or unleached. The upper PCD body 856*f* may be substantially similar to any upper PCD body described herein. The upper PCD body 856*f* may include a working surface 864*f* a lateral surface 866*f*. The lateral surface 866*f* may extend to the lateral surface 836*f* of the flange 830*f*, or may extend beyond the lateral surface 836*f* (e.g., substantially similar to the upper PCD body 856*d*).

In some embodiments (not shown), the section of the raised portion (e.g., 803, 803*d* or 8030 extending above the annular PCD body, including any flange (e.g., 830 or 8300, may instead include or be formed substantially entirely from an upper PCD body or separate substrate portion (e.g., an upper substrate). Such an upper PCD body or separate substrate portion may be sized and configured substantially the same as any raised portion extending above the annular PCD body, including any flange, described herein. The PCD body may be integrally formed or bonded (e.g., friction bonded, brazed, or fused) to the raised portion of the substrate. In another embodiment, the upper substrate may be bonded (e.g., friction bonded, brazed, or fused) to the raised portion of the substrate.

In some embodiments, a method of making a multi-tiered PDC 800 or 800*c* may include providing or forming a substrate 802 having a raised portion 803 extending from an interfacial surface 808 thereon, positioning an annular PCD body 806 including a working surface having a height about the same, greater than, or less than the raised portion, the bonding surface, and a lateral surface extending therebetween on the substrate 802. In some embodiments, the raised portion 803 may extend through the annulus (e.g., cavity or hole) in the annular PCD body 806, and bonding the substrate to the annular PCD body. Optionally, a material layer 811, such as any of those describe herein, may be positioned between the annular PCD body 806 and the substrate 802. The method may include positioning an upper substrate 852 on or adjacent to the raised portion 803 of the substrate 802, the upper substrate 852 may be bonded to an upper PCD body 856 prior to or after positioning the upper substrate 852 on the raised portion using any bonding process described herein, such as by way of non-limiting example, brazing, HPHT bonding. The upper PCD body 856 may be integrally formed on the on the upper substrate 852 (i.e., a one-step PDC) or may be formed separately from the upper substrate 852 and subsequently be bonded thereto using any bonding technique described herein. The method may include bonding the upper PCD body 856 (optionally having a lateral dimension larger than the lateral dimension of the raised portion 803) directly to the raised portion 803 of the substrate 802 in a substantially similar manner as any bonding process described herein. The PCD body 806, the substrate 802, the upper PCD body 856, and optionally, the upper substrate 852 may be bonded together substantially simultaneously (e.g., in a single HPHT bonding step) or at differing times. In some embodiments, the annular PCD body 806 may be positioned on but not bonded to the substrate 802 or material layer 811 thereon.

In some embodiments, the raised portion having a flange thereon may be formed by machining, lasing, or eroding, a substrate to create any of raised portions and/or a flanges described above. In some, embodiments, the annular PCD body having a cavity therein may be formed by machining, lasing, or eroding, a PCD body to create any of the cavities described above. In some embodiments, forming a PDC may include positioning (e.g., sliding) an annular PCD body having a cavity including protrusions, over a raised portion of a substrate including any flange thereon. The raised portion and cavity having a corresponding geometry and size. For example, where the raised portion includes a flange extending from the raised portion in discrete sections, the annular PCD body may have correspondingly shaped and configured protrusions further defining the cavity. The protrusions may be aligned with the gaps between the sections of the flange. The annular PCD body may be lowered over the raised portion until it contacts the interfacial surface of the substrate. The annular PCD body may be rotated about the raised portion until the protrusions therein are positioned under the flange. Such a configuration provides for mechanical vertical locking of the annular PCD body on the substrate. The annular PCD body and the substrate may be subjected to bonding by any of the methods described herein. In an embodiment, the annular PCD body may remain unbonded (e.g., free spinning under the flange).

Figure 9A:
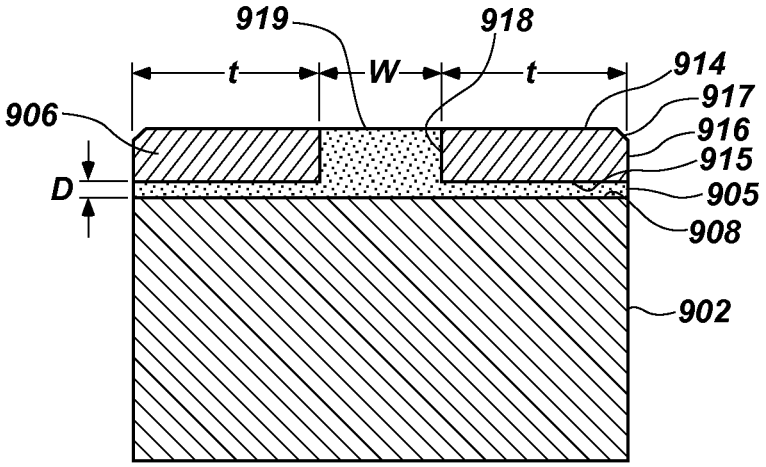
FIG. 9A is a side cross sectional view of an assembly for forming a PDC according to an embodiment.
Figure 9B:
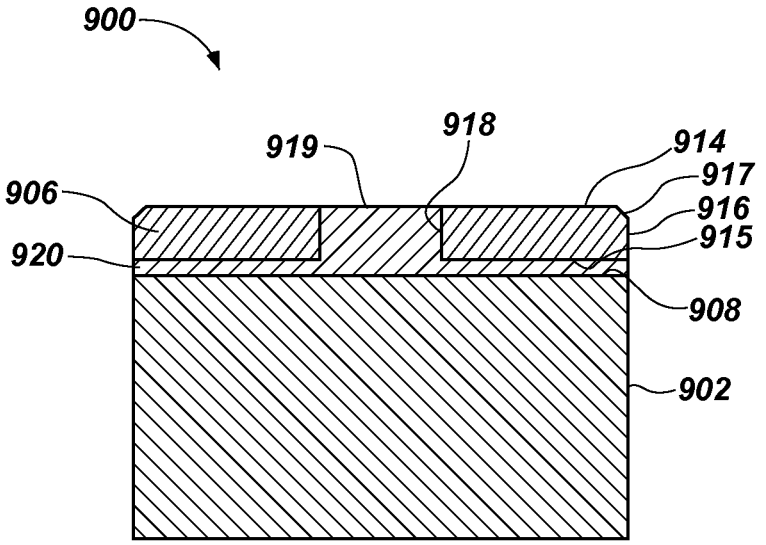
FIG. 9B is a side cross-sectional view of the PDC formed from the assembly illustrated in FIG. 9A.
Figure 9C:
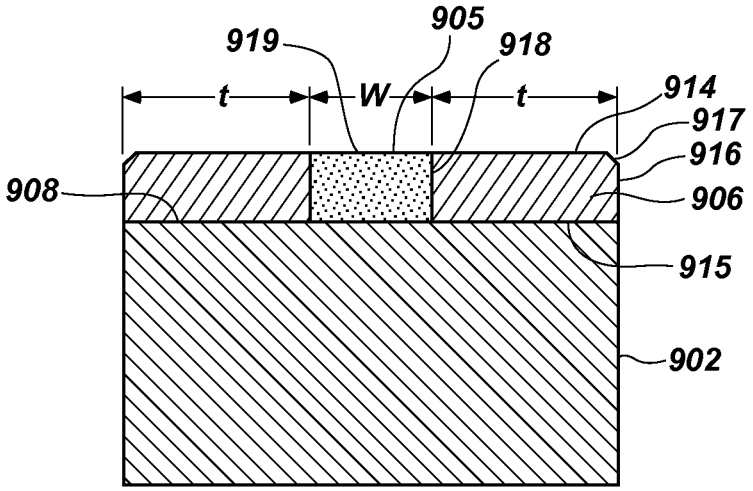
FIG. 9C is a side cross sectional view of an assembly for forming a PDC according to an embodiment.

Referring to FIGS. 9A-9I, in some embodiments, a preformed annular PCD body may be bonded to a substrate to form a PDC. As shown in FIGS. 9A and 9B, an annular PCD body 906 (e.g., a preformed annular PCD body) may be HPHT bonded to a substrate 902 using at least one diamond powder volume 905 therebetween and/or adjacent thereto to improve the bond strength and/or performance characteristics (e.g., shear strength and/or impact resistance of the PDC) between the annular PCD body 906 and the substrate 902. The resulting PDC 900 or 900*d* may include the preformed annular PCD body 906 bonded to the substrate 902 and/or a second PCD body 920 including the sintered diamond powder volume 905.

Figure 9D:
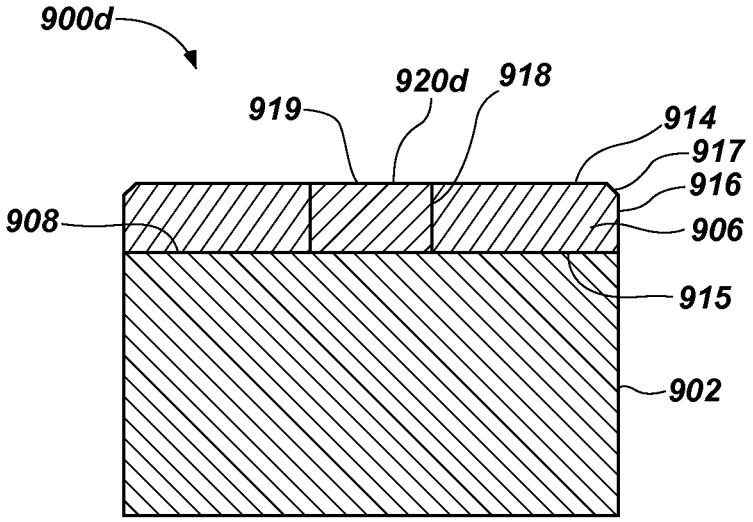
FIG. 9D is a side cross-sectional view of the PDC formed from the assembly illustrated in FIG. 9C.

The preformed annular PCD body 906 may include an upper, working surface 914; a lower, bonding surface 915; a lateral surface 916 defining the outer periphery of the preformed annular PCD body 906; and an interior surface 918 defining an inner periphery of the of the preformed annular PCD body 906 defining a hole 919 therein. Optionally, a peripherally extending edge chamfer 917 may be formed between the lateral surface 916 and the working surface 914. The substrate 902 includes an interfacial surface 908. The interfacial surface 908 may be planar or non-planar. The preformed annular PCD body 906 may include any of the materials in any of the amounts described herein, may exhibit any configuration (e.g., shape, leaching state, and size) described herein, and may be manufactured using any of the techniques described herein. In an embodiment, such as shown in FIG. 9A, the diamond powder volume 905 may be placed between the bonding surface 915 of the annular PCD body 906 and the interfacial surface 908 of the substrate 902 in addition to being placed at least partially within the hole 919 in the annular PCD body 906 prior to HPHT bonding, thereby forming a precursor assembly. In an embodiment shown in FIGS. 9C-9D, the annular PCD body 906 may be placed directly onto the substrate 902 and the diamond powder volume 905 may be placed on the interfacial surface 908 only at least partially within the hole 919 in the annular PCD body 906 prior to HPHT bonding, thereby forming a precursor assembly. Upon HPHT processing the precursor assembly, the second PCD body 920 or 920*d* may be formed between the interfacial surface 908 and the bonding surface 915, and within the hole 919 as shown in FIG. 9B, or only within the hole 919 as shown in FIG. 9D. The resulting PDCs 900 or 900*d* may exhibit desirable residual internal stresses, impact resistance, durability, or overall performance.

The annular PCD body 906 may be formed with any of the materials described herein to form a PCD body and by any of the processes disclosed herein to form a PCD body, including but not limited to, a one-step process, a two-step process, average particle size, number of average particles size modes, sintering pressure, sintering temperature, and catalyst material and amount. After an HPHT sintering process, the preformed annular PCD body 906 may include at least one catalyst material (e.g., a metal-solvent catalyst) within the plurality of interstitial spaces formed between bonded diamond grains during the HPHT sintering process. The catalyst material therein may be at least partially removed via a leaching process substantially similar to any described herein and to any leach depth described herein, or the annular PCD body 906 may be left in an unleached condition.

The geometry (i.e., overall shape) of the preformed annular PCD body 906 may be formed before and/or after the annular PCD body 906 is initially sintered and/or leached. The preformed annular PCD body 906 may exhibit the geometry illustrated in FIGS. 9A-9D, which may be formed by at least one of an annular mold, milling, EDM (e.g., wire EDM or plunge EDM), grinding, or lasing. For example, a diamond powder may be placed in a mold having a generally annular shape or cold pressed into a generally annular shape, whereby the mold having the diamond powder therein or the cold pressed diamond powder is loaded into an ultra-high pressure press and exposed to high temperature conditions sufficient to form diamond-to-diamond bonds in substantially the same manner as any HPHT sintering process described herein, whereby the sintered PCD body may exhibit a generally annular shape. In such an embodiment, the sintered annular PCD body 906 may be additionally processed to produce a final finished shape, such as by lasing, EDM, grinding, milling, or combinations thereof. The annular PCD body 906 may be leached prior to or after final shaping. In an embodiment, an annular PCD body 906 may be formed by sintering a diamond powder in substantially the same manner as any HPHT sintering process described herein, whereby the sintered PCD has a substantially cylindrical geometry, and subsequently, the method may include forming a hole 919 therein by lasing, EDM, grinding, milling, or combinations thereof.

The width "w" of the hole 919 may be at least partially defined by the dimension "t" of the annular PCD body 906. The total diameter or other lateral dimension of the annular PCD body 906 is defined by the total of the width "w" and two times the dimension "t." The thickness "t" may be selected based upon the desired working surface area, impact strength, wear resistance, or cost of the resulting annular PCD body 906. For example, a larger dimension "t" may impart a greater impact strength to the annular PCD body (i.e. a larger polycrystalline diamond mass through which an impact may be absorbed) but may cost more to form. The dimension "t" may be about 7/16 the total diameter of the annular PCD 906 body or less, such as about 7/16 to about 1/32 the total diameter of the annular PCD body 906, about 3/8 to about 1/16 the total diameter of the annular PCD body 906, about 1/2 to about 1/8 the total diameter of the annular PCD body 906, about 1/4 to about 1/3 the total diameter of the annular PCD body 906, about 7/16 to about 1/10 the total diameter of the annular PCD body 906, about 7/16, about 3/8, about 1/3, or about 1/4 of the total diameter of the annular PCD body 906. For example, the dimension "t" of the annular PCD body 906 may be about 14 mm or less, such as about 1 mm to about 14 mm, about 2 mm to about 12 mm, about 4 mm to about 10 mm, about 1 mm to about 8 mm, about 2 mm to about 7 mm, about 2 mm, about 4 mm, or about 6 mm.

The width "w" of the hole 919 in the annular PCD body 906 may be about 15/16 the total diameter or other lateral dimension of the annular PCD body 906 or less, such as about 15/16 to about 1/32, about 3/4 to about 1/16, about 1/2 to about 1/8, about 1/3 to about 1/4, about 1/10, about 1/4, about 1/3, about 1/2, or about 5/8 the total diameter or other lateral dimension of the annular PCD body 906. For example, the width w of the hole 919 in the annular PCD body 906 may be about 200 μm or more, such as about 300 μm to about 14 mm, about 1 mm to about 10 mm, about 2 mm to about 8 mm, about 3 mm to about 6 mm, about 3 mm, about 4 mm, about 5 mm, or about 6 mm.

The diamond powder volume 905 may be made using any of the pluralities of diamond particles (e.g., diamond powder) described herein including, but not limited to, average diamond particle size, number of modes, and, optionally, an amount of catalyst and/or infiltrant materials therein. For example, in some embodiments, the diamond powder volume 905 may include no catalyst material therein and a larger average diamond particle size than used to form the annular PCD body 906 to improve bonding of the annular PCD body 906 to the substrate 902. For example, the average diamond particle size of the diamond powder volume 905 may be about 1.5 to about 5 times (e.g., about 1.5 to about 2.5) larger than that of the diamond particles used to form the annular PCD body 906. However, in other embodiments, a smaller average diamond particle size may be selected for the diamond powder volume 905 to create greater wear resistance in the second PCD body 920 or 920*d*. For example, the annular PCD body 906 may exhibit an average diamond particles size of about 20 μm or less, such as about 2 μm to about 20 μm, about 5 μm to about 15 μm, or about 10 μm to about 20 μm; and the diamond powder volume 905 may exhibit an average diamond particle size of about 30 μm or more, such as about 30 μm to about 100 μm, about 45 μm to about 80 μm, or about 30 μm to about 60 μm.

While embodiments illustrated therein show the hole 919 having a substantially cylindrical shape, other shapes such as any of those describe herein with respect to the substrate bonding features may be used.

Figure 9E:
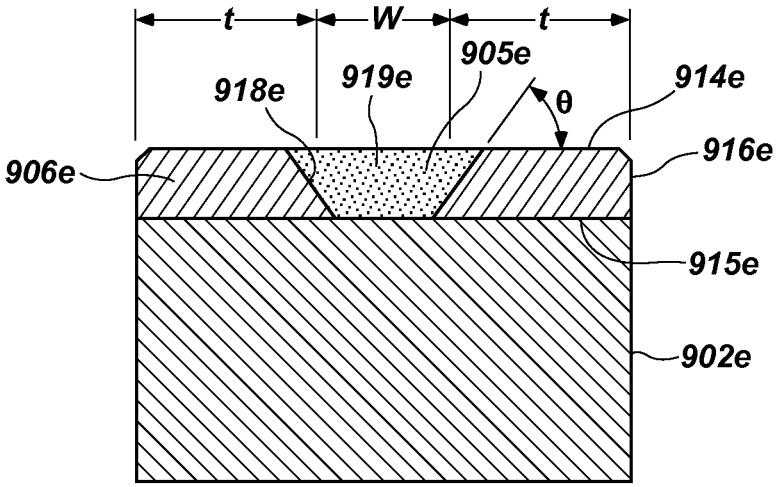
FIG. 9E is a side cross sectional view of an assembly for forming a PDC according to an embodiment.
Figure 9F:
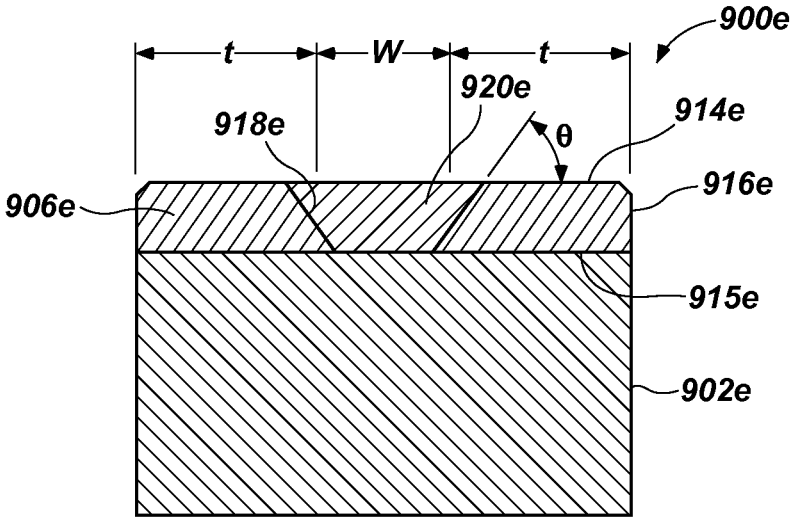
FIG. 9F is a side cross-sectional view of the PDC formed from the assembly illustrated in FIG. 9E.

While embodiments described and illustrated herein show interior surfaces 918 substantially perpendicular to the working surface 914 of the annular PCD body 906, alternative embodiments may include an interior surface 918 that may be substantially non-perpendicular to the working surface 914. For example, as illustrated in FIGS. 9E and 9F, a PDC 900*e* may include an annular PCD body 906*e* substantially similar in configuration to annular PCD body 906 and having an interior surface 918*e* that forms an angle θ with respect to a plane generally parallel to a working surface 914*e* and/or a bonding surface 915*e* of about 30 degrees or more, such as about 30 degrees to 150 degrees, about 45 degrees, to about 135 degrees, about 60 degrees to about 120 degrees, about 75 degrees to about 105 degrees, about 60 degrees, about 60 degrees, about 120 degrees, or about 105 degrees. In embodiments in which the angle θ is less than 90 degrees, the bonding surface 915*e* may have a larger surface area than the working surface 914*e*. When the annular PCD body 906*e* is placed onto the substrate 902*e* and a diamond powder volume 905*e* is poured or otherwise positioned within the hole 919*e* to form a precursor assembly which is then placed in a pressure transmitting medium and subjected to HPHT sintering conditions similar to any of those described herein, the resulting second PCD body 920*e* may provide improved mechanical retention of the annular PCD body 906*e* on the substrate by creating an undercut under which the annular PCD body 906*e* is retained against the substrate 902*e*. In such an embodiment the surface area of the working surface 914*e* may be less than the surface area of the bonding surface 915*e*.

In some embodiments, it may be desirable to provide a larger working surface with respect to the bonding surface in order to provide more bonding between the second PCD body 920*e* and the substrate 902*e*. In embodiments in which the angle θ is larger than 90 degrees (not illustrated) the surface area of the working surface 914*e* may be larger than the surface area of the bonding surface 915*e*.

In some embodiments, the angle θ may be selected to provide a desired ratio of working surface 914*e* area to bonding surface 915*e* area of the annular PCD body 906*e*. For example, the angle θ may be selected to provide a smaller ratio of working surface 914*e* area to bonding surface 915*e* area in the annular PCD body 906*e*, such as by way of non-limiting example, less than 1, less than about 1 to more than zero, about 1 to about 0.1, about 0.8 to about 0.2, about 0.6 to about 0.4, about 0.3, about 0.5, or about 0.7. In an embodiment, the angle θ may be selected to provide a larger ratio of working surface 914*e* area to bonding surface 915*e* area in the annular PCD body 906*e*, such as by way of non-limiting example, more than 1, more than about 1 to less than 2, about 1.1 to about 1.9, about 1.2 to about 1.8, about 1.4 to about 1.6, about 1.3, about 1.5, or about 1.7.

While a single hole 919 is illustrated and described herein with respect to the annular PCD body 906, a plurality of holes may be formed in the a PCD body according to any of the shapes, and widths described herein. A plurality of holes 919 may be positioned and spaced throughout a PCD body in any configuration. For example, a plurality of holes may be formed in a ring configuration substantially parallel to and interior to the lateral surface of a PCD body. A cluster, rectangular, triangular configuration may be used. A hole 919 may be positioned at the center of or off center of the working surface 914 of the annular PCD body 906 to provide a larger working surface on a portion of the resulting PDC.

Figure 9G:
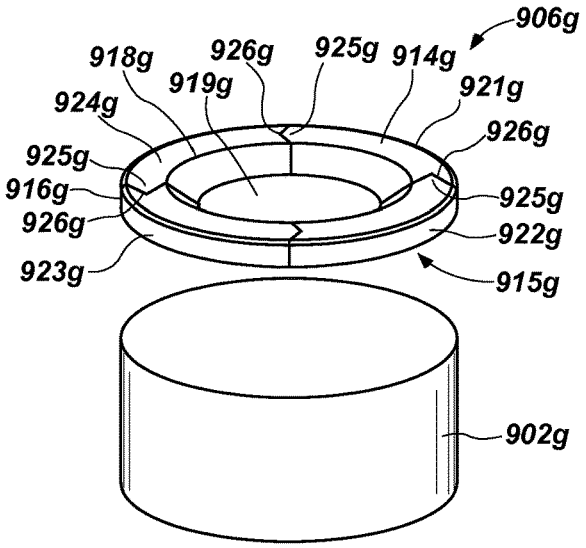
FIG. 9G is an exploded isometric view of a portion of an assembly for making a PDC according to an embodiment.
Figure 9H:
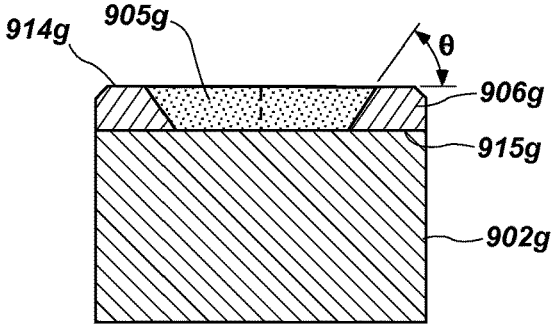
FIG. 9H is a side cross-sectional view of an assembly for forming a PDC according to an embodiment.
Figure 9I:
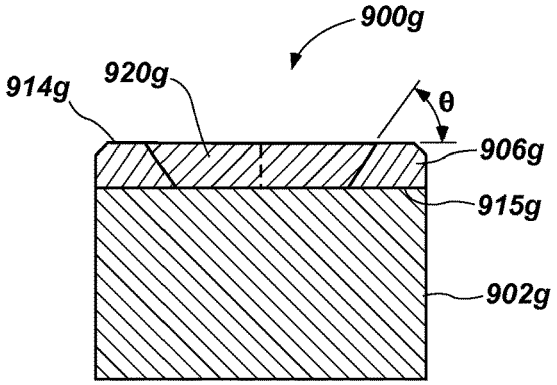
FIG. 9I is a side cross-sectional view of the PDC formed from the assembly illustrated in FIG. 9H.

In some embodiments, any of the elements, configurations (e.g., shapes, sizes, angles, compositions, segments, holes, substrate bonding features, interlocking features, etc.) or portions of configurations disclosed herein may be used in combination with each other without limitation to provide a desired combination of improved performance characteristics including but not limited to reduced residual stresses, decreased crack propagation during operation, increased bonding strength between the PCD bodies and the substrate, greater impact resistance, or combinations of any of the foregoing. For example, FIGS. 9G-9I illustrate a PDC 900*g* including an annular multiple segment PCD body 906*g*. FIG. 9G shows the annular multiple segment PCD body 906*g* including a plurality of PCD segments 921*g*-924*g* circumferentially adjacent to one another, including protruding segment interlocking features 925*g* and indented segment interlocking features 926*g* thereon. The plurality of PCD segments 921*g*-924*g* collectively define a working surface 914*g*, a bonding surface 915*g*, a lateral surface 916*g* extending therebetween and defining an outer periphery of the PCD body, an interior surface 918*g* extending between the working surface 914*g* and the bonding surface 915*g* and defining an inner periphery of the PCD body 906*g* and defining a hole 919*g* therein. The segment interlocking features 925*g* and 926*g* may exhibit a protruding or indented (i.e. male and female) chevron shape, respectively, or any other suitable interlocking feature shape disclosed herein. As illustrated in FIGS. 9H and 9I, the interior surface 918*g* may form an angle θ relative to the working surface 914*g*, such that when the angle θ is less than 90 degrees, the hole 919*g* exhibits a generally conical shape into which a diamond powder volume 905*g* may be poured or otherwise positioned. Upon HPHT sintering, the diamond powder volume 905*g* may be sintered to form a second PCD body 920*g* having a plurality of bonded diamond grains therein and being bonded to both the substrate and the annular multiple segment PCD body 906*g*. In another embodiment (not shown), the diamond powder volume 905*g* may also be positioned between the substrate 902*g* and the annular PCD body 906*g*, similar to the PDC described with respect to FIG. 9A. The resulting PDC may exhibit one or more of reduced residual stresses, decreased crack propagation during operation, increased bonding strength between the PCD bodies and the substrate, desirable impact resistance/durability, or combinations of any of the foregoing. Embodiments, of methods of making the PDCs in FIGS. 9A-9I may be combinations of the methods of making the any of the PDCs described herein.

In an embodiment (not illustrated), the PCD body 906 may including a plurality of segments such as those described above, optionally including interlocking features on an interior surface (e.g., inner periphery) therein. Subsequent filling of the annular region with powder material and HPHT sintering process may form second PCD body 920*g* having substrate interlocking features thereon, the substrate interlocking features comprising at least a portion of the angled interior surface. Differing angles θ similar to any of those described herein may be used and differing segment configurations similar to any of those described herein may be used in such an embodiment.

As noted above, in the embodiments discussed with respect to FIGS. 5A-9I, notwithstanding that the substrates therein have been discussed without a PCD layer thereon (such as disclosed with respect to FIGS. 4A-4D), such a PCD layer may be used in any of the embodiments discussed in relation to FIGS. 5A-9I as part of the substrate in any of the conformations (e.g., shapes, thicknesses, raised features) described therein.

Figure 10:
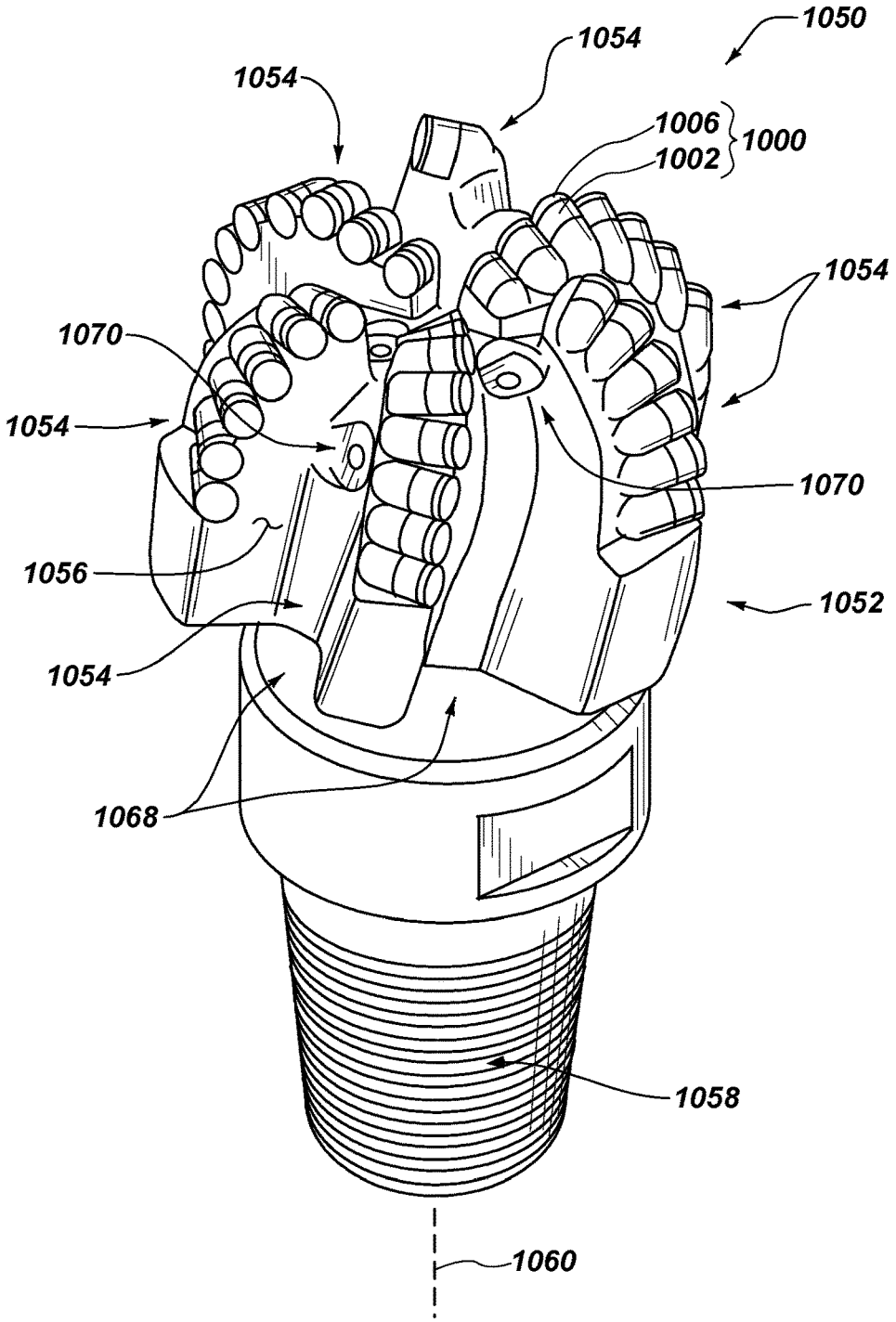
FIG. 10 is an isometric view of an embodiment of a rotary drill bit that may employ one or more of the disclosed PDC embodiments.
Figure 11:
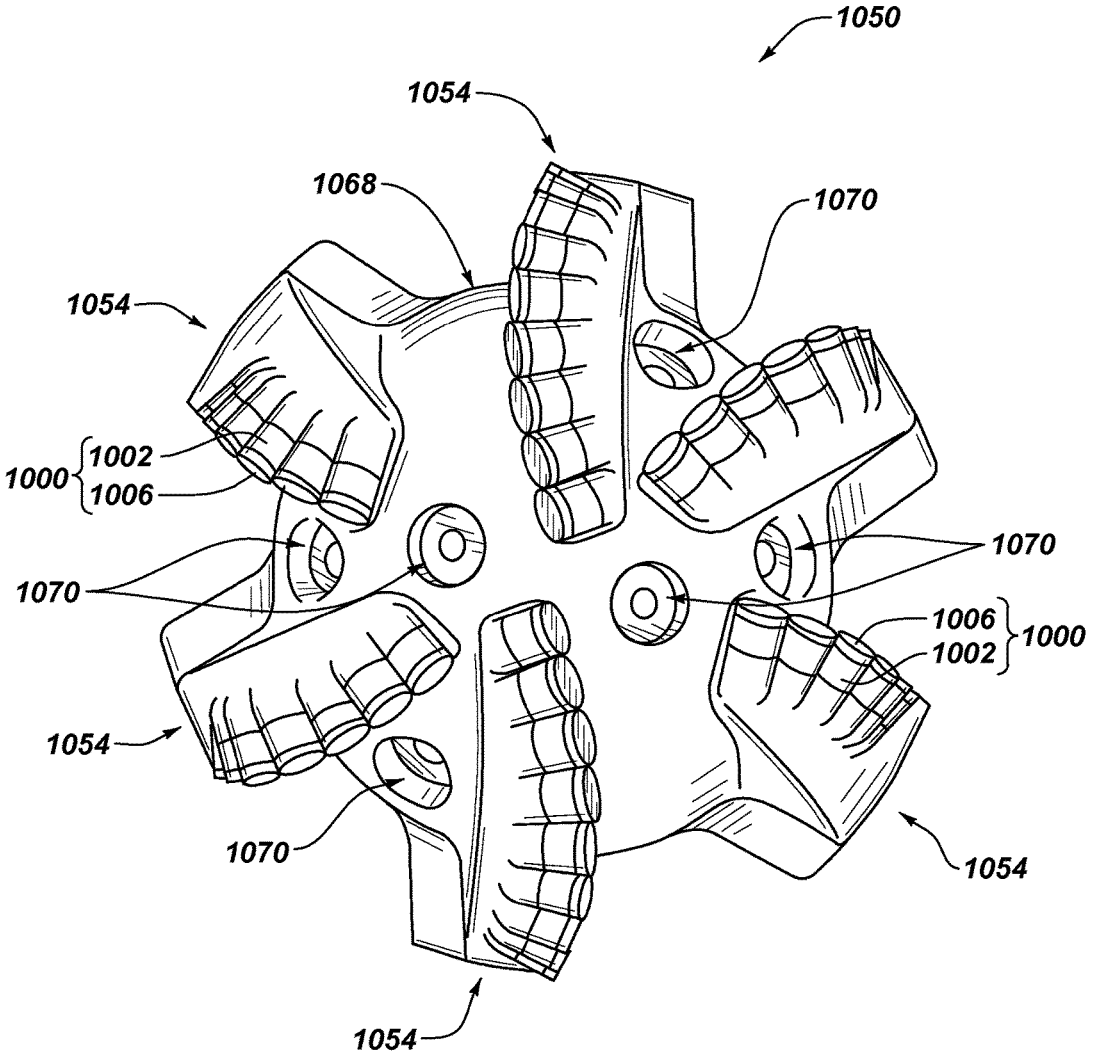
FIG. 11 is a top elevation view of the rotary drill bit shown in FIG. 10.

The PCD bodies and PDCs described herein may be used in a variety of applications, such as PCD cutting elements on rotary drill bits. FIG. 10 is an isometric view and FIG. 11 is a top elevation view of an embodiment of a rotary drill bit 1050. The rotary drill bit 1050 includes at least one PCD body, such as a PDC, tested/characterized/designed according to any of the previously described methods. The rotary drill bit 1050 includes a bit body 1052 that includes radially and longitudinally extending blades 1054 with leading faces 1056, and a threaded pin connection 1058 for connecting the bit body 1052 to a drilling string. The bit body 1052 defines a leading end structure for drilling into a subterranean formation by rotation about a longitudinal axis 1060 and application of weight-on-bit. At least one PDC cutting element 1000, configured according to any of the previously described PCD bodies and substrates (e.g., the PDC shown in FIG. 6C), may be affixed to the bit body 1052. With reference to FIG. 11, each of a plurality of PDC cutting elements 1000 is secured to the blades 1054. For example, each PDC cutting element 1000 may include a PCD body 1006 bonded to a substrate 1002. More generally, the PDC cutting elements 1000 may include any PCD or superabrasive element disclosed herein, without limitation. Also, circumferentially adjacent blades 1054 so-called junk slots 1068 are defined therebetween, as known in the art. Additionally, the rotary drill bit 1050 may include a plurality of nozzle cavities 1070 for communicating drilling fluid from the interior of the rotary drill bit 1050 to the PDC cutting elements 1000.

FIGS. 10 and 11 merely illustrate one embodiment of a rotary drill bit that employs at least one PDC cutting element that includes a PCD body and substrate configured and fabricated in accordance with the disclosed embodiments, without limitation. The rotary drill bit 1050 is used to represent any number of earth-boring tools or drilling tools, including, for example, core bits, roller-cone bits, fixed-cutter bits, eccentric bits, bicenter bits, reamers, reamer wings, or any other downhole tool including superabrasive compacts, without limitation.

The PCD bodies and PDCs disclosed herein may also be utilized in applications other than cutting technology. For example, the disclosed PCD bodies and/or PDCs may be used in wire dies, bearings, artificial joints, inserts, cutting elements, and heat sinks. Thus, any of the PCD bodies disclosed herein may be employed in an article of manufacture including at least one superabrasive element or compact.

Thus, the embodiments of the PCD bodies and PDCs disclosed herein may be used in any apparatus or structure in which at least one conventional superabrasive compact is typically used. In one embodiment, a rotor and a stator, assembled to form a thrust-bearing apparatus, may each include one or more superabrasive compacts configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing PCD elements disclosed herein may be incorporated. The embodiments of the PCD bodies and PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the superabrasive compacts disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,180,022; 5,460,233; 5,544,713; 6,793,681; and 7,870,913, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A method for making a polycrystalline diamond compact ("PDC"), the method comprising:

forming a polycrystalline diamond ("PCD") body having an upper surface, a lower bonding surface generally opposite the upper surface, and at least one lateral surface extending therebetween;

providing a substrate having an interfacial surface including at least one substrate bonding feature thereon having one or more at least partially leached and sintered PCD portions;

positioning the interfacial surface of the substrate including the at least one substrate bonding feature thereon adjacent to the lower bonding surface of the PCD body; and subjecting the substrate and the PCD body to a bonding process including at least one of an HPHT process or a brazing process.

2. The method of claim 1, wherein the at least one substrate bonding feature includes a raised portion.

3. The method of claim 2, wherein:

the PCD body includes a complementary configuration to the raised portion on the bonding surface thereof; and positioning the interfacial surface of the substrate including the at least one substrate bonding feature thereon adjacent to the lower bonding surface of the PCD body includes interlocking the at least one substrate bonding feature and the bonding surface of the substrate having a complementary configuration thereto by positioning the PCD body over the substrate in which the complementary configuration allows the PCD body to fit on and around the raised portion.

4. The method of claim 2, wherein the raised portion is positioned generally in a center of the interfacial surface of the substrate, the raised feature exhibiting a thickness at least about half of a thickness of the PCD body, and the PCD body includes a complementary cavity therein, wherein the raised portion fits in the complementary cavity.

5. The method of claim 2, wherein the raised portion is positioned generally in a center of the interfacial surface of the substrate, the raised portion exhibiting a thickness substantially equal to a thickness of the PCD body and the PCD body includes a complementary cavity extending substantially through the entire PCD body, wherein the raised portion fits in the complementary cavity.

6. The method of claim 2, wherein the raised portion exhibits a cylindrical shape.

7. The method of claim 1, wherein the one or more at least partially leached and sintered PCD portions extend from the interfacial surface to an intermediate depth within the substrate.

8. The method of claim 7, wherein at least one of the one or more at least partially leached and sintered PCD portions exhibits an annular geometry extending about a lateral surface of the substrate at the interfacial surface, an annular geometry extending interior to the lateral surface of the substrate, or a linear geometry extending across the interfacial surface of the substrate.

9. The method of claim 1, where the at least one substrate bonding feature is coplanar with the interfacial surface.

* * * * *